US009217962B2

(12) United States Patent
Karashima et al.

(10) Patent No.: US 9,217,962 B2
(45) Date of Patent: Dec. 22, 2015

(54) IMAGE FORMING APPARATUS

(75) Inventors: Kenji Karashima, Tokyo (JP); Satoshi Tsuruya, Mishima (JP); Yoshikuni Ito, Tokyo (JP); Yasuhiro Horiguchi, Tokyo (JP); Takeshi Fujino, Yokohama (JP); Takahiro Kawamoto, Yokohama (JP); Takayuki Tanaka, Tokyo (JP); Osamu Iwasaki, Yokohama (JP); Kazunari Hagiwara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 13/995,640

(22) PCT Filed: Dec. 9, 2011

(86) PCT No.: PCT/JP2011/079120

§ 371 (c)(1),
(2), (4) Date: May 19, 2014

(87) PCT Pub. No.: WO2012/086525

PCT Pub. Date: Jun. 28, 2012

(65) Prior Publication Data

US 2014/0321891 A1 Oct. 30, 2014

(30) Foreign Application Priority Data

Dec. 20, 2010 (JP) ..... 2010-283772
Jul. 25, 2011 (JP) ..... 2011-161868

(51) Int. Cl.
*G03G 15/16* (2006.01)
*G03G 15/01* (2006.01)

(52) U.S. Cl.
CPC ..... *G03G 15/1645* (2013.01); *G03G 15/0189* (2013.01); *G03G 15/161* (2013.01); *G03G 15/162* (2013.01); *G03G 15/1605* (2013.01); *G03G 15/1675* (2013.01); *G03G 15/1685* (2013.01); *G03G 2215/0132* (2013.01)

(58) Field of Classification Search
CPC ..... G03G 15/0189; G03G 15/1605; G03G 15/161; G03G 15/162; G03G 15/1645; G03G 15/1675; G03G 15/1685; G03G 2215/0132
See application file for complete search history.

(56) References Cited

U.S. PATENT DOCUMENTS 5,978,638 A * 11/1999 Tanaka et al. ..... 399/302
9,052,677 B2 * 6/2015 Horiguchi et al. ..... 1/1

FOREIGN PATENT DOCUMENTS

| | | | |
|---|---|---|---|
| JP | 10-268667 | A | 10/1998 |
| JP | 2001-125338 | A | 5/2001 |
| JP | 2001-175092 | A | 6/2001 |
| JP | 2003-35986 | A | 2/2003 |
| JP | 2005-250254 | A | 9/2005 |
| JP | 2006-259640 | A | 9/2006 |
| JP | 2009-205012 | A | 9/2009 |

* cited by examiner

*Primary Examiner* — Joseph S Wong
(74) *Attorney, Agent, or Firm* — Canon U.S.A., Inc. IP Division

(57) ABSTRACT

The present invention relates to an image forming apparatus that forms an image by consecutively superposing toner images that have been formed on a plurality of photosensitive drums, on an intermediate transfer member or a transfer medium. The image forming apparatus is made compact and operates at a low cost. Since a current supply member supplies a current in a rotational direction of an intermediate transfer belt, multiple first transfer portions do not need corresponding voltage sources. Even in the case where a charging member supplies a current, the potential of the intermediate transfer belt is maintained at a predetermined potential by a constant-voltage element connected to support rollers.

12 Claims, 16 Drawing Sheets

IMAGE FORMING APPARATUS

TECHNICAL FIELD

The present invention relates to image forming apparatuses including copying machines and laser printers.

BACKGROUND ART

An electrophotographic color image forming apparatus has independent image forming parts for forming yellow, magenta, cyan, and black images. The images of these colors are consecutively transferred from the image forming parts to an intermediate transfer belt, and then the images are collectively transferred from the intermediate transfer belt to a recording media. Thus, the electrophotographic color image forming apparatus achieves high speed printing.

The image forming parts for these colors each include a photosensitive drum, which serves as an image bearing member, a charging member, which charges the photosensitive drum, and a developing unit, which develops a toner image onto the photosensitive drum. The charging member of each image forming part comes into contact with the corresponding photosensitive drum at a predetermined pressure, and charges the surface of the photosensitive drum with a charging voltage applied from a charging voltage source in such a manner that the surface uniformly has a predetermined potential with a predetermined polarity.

The developing unit of each image forming part attaches toner to an electrostatic latent image formed on the corresponding photosensitive drum and then develops the latent image into a toner image (visible image).

Toner images developed onto the photosensitive drums of the image forming parts are first-transferred to the intermediate transfer belt by first transfer rollers, which are opposite the photosensitive drums with the intermediate transfer belt being interposed therebetween and which serve as first transfer portions. The first transfer rollers are connected to corresponding first-transfer voltage sources.

The toner images that have been first-transferred to the intermediate transfer belt are then second-transferred to a transfer medium by a second transfer unit. A second transfer roller that serves as the second transfer unit is connected to a second-transfer voltage source.

PTL 1 discloses an apparatus that includes four first transfer rollers connected to four corresponding first-transfer voltage sources. PTL 2 discloses an apparatus that performs control so that, before an image forming operation, a transfer voltage to be applied to each first transfer roller is changed in accordance with the properties of the intermediate transfer belt and the first transfer roller, including a sheet-feeding durability and a resistance that varies due to environmental changes.

PTL 3 discloses an image forming apparatus of a known type in which a residual toner remaining on an intermediate transfer belt is charged by a charging member and then transferred to an image forming part in a first transfer portion to be recovered. In this structure, the image forming part recovers the residual toner on the intermediate transfer belt. Thus, the need for a waste-toner container dedicated to the intermediate transfer belt is eliminated, and a compact apparatus is achieved, accordingly.

CITATION LIST

Patent Literature

PTL 1 Japanese Patent Laid-Open No. 2003-35986
PTL 2 Japanese Patent Laid-Open No. 2001-125338
PTL 3 Japanese Patent Laid-Open No. 2009-205012

SUMMARY OF INVENTION

Technical Problem

However, the above-described image forming apparatuses have the following problems. With a known method of setting first transfer voltages, each image forming part is required to set an appropriate first transfer voltage, and thus multiple voltage sources are needed. This increase in the number of voltage sources resultantly increases the size and the cost of the image forming apparatuses.

Moreover, since an appropriate first transfer voltage is calculated on the basis of the varying resistance of each first transfer portion before the image forming operation, it may take a long time until image formation is started. Further, when the first transfer portion in each image forming part presses the corresponding photosensitive drum via the intermediate transfer belt at a predetermined pressure to supply a current to the photosensitive drum, the photosensitive drum being subjected to the load may wear earlier than expected.

Further, when the toner-charging member charges the residual toner that has not arrived at the first transfer portion, the intermediate transfer belt is also charged at the same time. This charging may raise the voltage of the intermediate transfer belt and affect the transfer unit performance in the case of a first transfer of the subsequent toner image.

In view of the above problems, the present invention provides an image forming apparatus that includes fewer voltage sources, is made compact, and is capable of recovering a residual toner remaining on an intermediate transfer belt by use of image forming parts while maintaining an appropriate first transfer performance of the transfer unit.

Solution to Problem

Image forming apparatuses according to embodiments of the present invention have the following structures to solve the above problems.

Advantageous Effects of Invention

With an image forming apparatus according to an embodiment of the present invention, a current supply member supplies a current in a rotational direction of an intermediate transfer belt, and thus multiple first transfer portions no longer need corresponding voltage sources. Even when a toner-charging member supplies a current to the intermediate transfer belt, the potential of the intermediate transfer belt can be maintained at a predetermined potential. Thus, the apparatus is made compact and operates at a low cost.

DESCRIPTION OF EMBODIMENTS

First Embodiment

Embodiments of the present invention will be exemplarily described in detail below with reference to the drawings. Note that components described in the embodiments are mere examples, and the scope of the present invention is not limited to these components.

Figure 1:
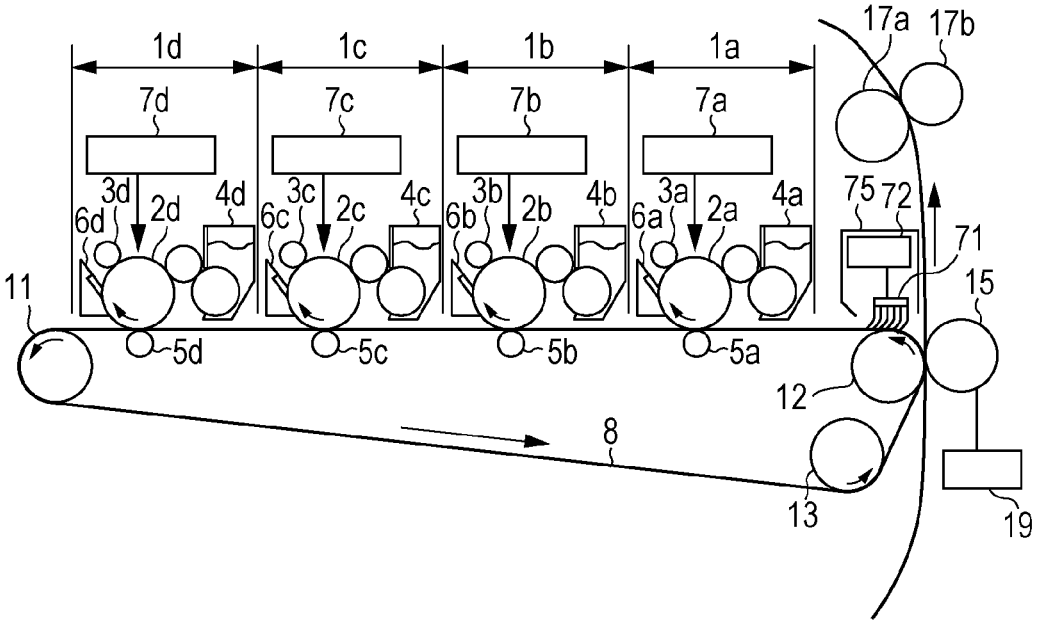
FIG. 1 is a schematic sectional view illustrating an image forming apparatus according to an embodiment of the present invention.

FIG. 1 illustrates a structure of an inline (four drum system) color image forming apparatus according to a first embodiment. The image forming apparatus includes four image forming parts: an image forming part 1*a* for forming a yellow image, an image forming part 1*b* for forming a magenta image, an image forming part 1*c* for forming a cyan image, and an image forming part 1*d* for forming a black image. These four image forming parts are arranged in a line at certain intervals.

The image forming parts 1*a*, 1*b*, 1*c*, and 1*d* respectively include photosensitive drums 2*a*, 2*b*, 2*c*, and 2*d*, which serve as image bearing members. In the first embodiment, the photosensitive drums 2*a*, 2*b*, 2*c*, and 2*d* each have a drum base (not illustrated), which is a negatively-charged organic photosensitive member made of aluminum or the like, and a photosensitive layer (not illustrated) formed on the drum base. The photosensitive drums 2*a*, 2*b*, 2*c*, and 2*d* are rotatably driven by a driving unit (not illustrated) at a predetermined process speed.

Charging rollers 3*a*, 3*b*, 3*c*, and 3*d*, which serve as charging members, and developing units 4*a*, 4*b*, 4*c*, and 4*d* are respectively arranged around the photosensitive drums 2*a*, 2*b*, 2*c*, and 2*d*. Further, drum cleaning devices 6*a*, 6*b*, 6*c*, and 6*d* are respectively arranged around the photosensitive drums 2*a*, 2*b*, 2*c*, and 2*d*. Exposure units 7*a*, 7*b*, 7*c*, and 7*d* are respectively arranged above the photosensitive drums 2*a*, 2*b*, 2*c*, and 2*d*. The developing units 4*a*, 4*b*, 4*c*, and 4*d* respectively contain a yellow toner, a magenta toner, a cyan toner, and a black toner. The toners used in the first embodiment are normally charged with a negative polarity.

A rotatable endless intermediate transfer belt 8, which serves as an intermediate transfer member, is disposed so as to be opposite the image forming parts. The intermediate transfer belt 8 is supported by a driving roller 11, an opposing roller for second transfer 12, and a tension roller 13 (these three rollers serve as support members). When the driving roller 11 connected to a motor (not illustrated) is driven, the intermediate transfer belt 8 is rotated (moved) in the direction indicated by an arrow in FIG. 1 (in the counter-clockwise direction). Hereinbelow, this rotational direction of the intermediate transfer belt 8 is also referred to as a circumferential direction of the intermediate transfer belt 8. The driving roller 11 has a highly frictional rubber layer as a surface layer in order to drive the intermediate transfer belt 8. The electrical conductivity of the rubber layer is determined in such a manner that the rubber layer has a volume resistivity of $10^5$ Ωcm or lower. The opposing roller for second transfer 12 and a second transfer roller 15, which is opposite the opposing roller for second transfer 12 with the intermediate transfer belt 8 interposed therebetween, together form a second transfer unit. The opposing roller for second transfer 12 includes a rubber layer for a surface layer. The electrical conductivity of the rubber layer is determined in such a manner that the rubber layer has a volume resistivity of $10^5$ Ωcm or lower. The tension roller 13, which is a metal roller, applies a total tension of approximately 60 N to the intermediate transfer belt 8, and is driven to rotate by the intermediate transfer belt 8.

The driving roller 11, the opposing roller for second transfer 12, and the tension roller 13 are grounded via resistors with predetermined values of resistance. In the first embodiment, resistors with three values of resistance of 1 GΩ, 100 MΩ, and 10 MΩ are employed. The resistance of the rubber layers of the driving roller 11 and the opposing roller for second transfer 12 is far smaller than 1 GΩ, 100 MΩ, and 10 MΩ, and thus the electric effect of the resistance of these rubber layers is negligible.

An elastic roller with a volume resistivity of $10^7$ to $10^9$ Ωcm and a rubber hardness of 30° (measured by asker C durometer) is employed as the second transfer roller 15. The second transfer roller 15 is pressed against the opposing roller for second transfer 12 at a total pressure of approximately 39.2 N via the intermediate transfer belt 8. The second transfer roller 15 is driven to rotate by rotation of the intermediate transfer belt 8. Further, a voltage of −2.0 to 7.0 kV is applicable to the second transfer roller 15 from a transfer power source 19. As will be described below, a voltage is applied to the second transfer roller 15 according to the first embodiment from the transfer power source 19 that is a voltage source used in common for first transfers and second transfers. The second transfer roller 15 is a current supply member that supplies a current in the circumferential direction of the intermediate transfer belt 8. Thus, the transfer power source 19 is a power source that applies a voltage, used for transfers, to the current supply member.

A toner charging unit (also referred to as a cleaning unit) 75 is disposed on the outer side of the intermediate transfer belt 8. The toner charging unit 75 removes and recovers a residual toner remaining on the surface of the intermediate transfer belt 8 after a first transfer is complete. A cleaning brush 71, which serves as a charging member, included in the toner charging unit 75 is made of almost densely arranged nylon fibers having an electric conductivity of $10^6$ to $10^9$ Ωcm. A tip end portion of the cleaning brush 71 is located so that the tip end portion is pressed into the surface of the intermediate transfer belt 8 by an amount of 1.0 mm.

The length of the cleaning brush 71 in the longitudinal direction, which traverses the moving direction of the surface of the intermediate transfer belt 8, is approximately equivalent to the width of a formable-image region, which extends in the longitudinal direction of the cleaning brush 71, formed on the intermediate transfer belt 8. The cleaning brush 71 brushes the surface of the intermediate transfer belt 8 with the movement of the intermediate transfer belt 8. A voltage of −2.0 to +2.0 kV is applicable to the cleaning brush 71 from a cleaning power source (charging power source) 72, which serves as a charging power source.

A fixing device 17 including a fixing roller 17*a* and a pressure roller 17*b* is arranged further downstream, in the rotational direction of the intermediate transfer belt 8, than the second transfer unit, in which the opposing roller for second transfer 12 and the second transfer roller 15 come into contact with each other.

Next, an image forming operation will be described.

Once a controller (not illustrated) outputs a start signal to start an image forming operation, transfer media (recording media) are fed one by one from a cassette (not illustrated) and conveyed to a registration roller (not illustrated). At this time, the registration roller is in the stationary state and the tip end of the transfer medium is held immediately before the second transfer unit. When the start signal is output, the photosensitive drums 2*a*, 2*b*, 2*c*, and 2*d* of the image forming parts 1*a*, 1*b*, 1*c*, and 1*d* start rotating at a predetermined process speed. In the first embodiment, the charging rollers 3*a*, 3*b*, 3*c*, and 3*d* uniformly charge the photosensitive drums 2*a*, 2*b*, 2*c*, and 2*d*, respectively, with a negative polarity. The exposure units 7*a*, 7*b*, 7*c*, and 7*d* respectively scan and expose the photosensitive drums 2*a*, 2*b*, 2*c*, and 2*d* to laser beams and thus form electrostatic latent images.

Then, firstly, the developing unit 4*a* applied with a development voltage with the same polarity (negative polarity) as the charging polarity of the photosensitive drum 2*a* attaches a yellow toner to the electrostatic latent image formed on the photosensitive drum 2*a* to make the latent image visible as a toner image. The charging amount and the exposure amount are adjusted in such a manner that an image portion of each photosensitive drum has a potential of −500 V after being charged by the corresponding charging roller, and a potential of −100 V after the exposure by the corresponding exposure unit. The developing bias is set to −300 V. The process speed is set to 250 mm/sec. The width of a formable image, which extends in a direction perpendicular to the transfer direction (rotational direction), is set to 215 mm, the quantity of charge in the toner is set to −40 μC/g, and the amount of toner placed on an image attached portion of the photosensitive drum is set to 0.4 mg/cm$^2$.

The yellow toner image is first-transferred onto the rotating intermediate transfer belt 8. Here, portions or positions of the intermediate transfer belt 8 that are opposite the photosensitive drums 2*a*, 2*b*, 2*c*, and 2*d* and to which the photosensitive drums 2*a*, 2*b*, 2*c*, and 2*d* transfer toner images are referred to as first transfer portions. The intermediate transfer belt 8 has multiple first transfer portions that correspond to the multiple image bearing members. A structure, in the first embodiment, for first-transferring the yellow toner image onto the intermediate transfer belt 8 will be described below.

The toner images held on the multiple image bearing members are first-transferred to the multiple first transfer portions of the intermediate transfer belt 8 so as to correspond to the multiple image bearing members. As illustrated in FIG. 1, opposed members 5*a*, 5*b*, 5*c*, and 5*d* are disposed at such positions as to be opposite the image forming parts 1*a*, 1*b*, 1*c*, and 1*d* via the intermediate transfer belt 8. When the opposed members 5*a*, 5*b*, 5*c*, and 5*d* press the intermediate transfer belt 8 against the photosensitive drums 2*a*, 2*b*, 2*c*, and 2*d*, the first transfer portions are formed and allowed to have a wide and stable width. In the first embodiment, the opposed members 5*a*, 5*b*, 5*c*, and 5*d* are not voltage applicable members connected to first-transfer voltage sources, but are electrically insulated members. Voltage applicable members (or first transfer rollers 55*a*, 55*b*, 55*c*, and 55*d*) illustrated in FIG. 4 have a desired electric conductivity so as to allow a desired current to flow therethrough, and thus are required to be subjected to a resistance adjustment, which leads to a cost increase.

Along with rotation of the intermediate transfer belt 8, the portion to which the yellow toner image is transferred moves closer to the image forming part 1*b*. Likewise, the image forming part 1*b* also transfers a magenta toner image formed on the photosensitive drum 2*b* onto the yellow toner image placed on the intermediate transfer belt 8, in a superposing manner. In the same manner, cyan and black toner images that are respectively formed on the photosensitive drums 2*c* and 2*d* of the image forming parts 1*c* and 1*d* are sequentially superposed on the yellow and magenta toner images that have been transferred onto the intermediate transfer belt 8 in a superposing manner. Thus, a full-color toner image is formed on the intermediate transfer belt 8.

The registration roller (not illustrated) conveys a transfer medium P to the second transfer unit at the timing when a tip end portion of the full-color toner image on the intermediate transfer belt 8 arrives at the second transfer unit. The full-color toner image on the intermediate transfer belt 8 is collectively second-transferred to the transfer medium P by the second transfer roller 15, which is a second transfer component to which a second transfer voltage (a voltage with a polarity that is opposite to that applied to the toners, or with a positive polarity) is applied. The transfer medium P on which the full-color toner image has been formed is conveyed to the fixing device 17. The full-color toner image is heated and pressurized by the fixing device 17 that includes the fixing roller 17*a* and the pressure roller 17*b*, and is thermally fixed to the surface of the transfer medium P. Then, the transfer medium P is output to the outside. In the first embodiment, a residual toner that remains on the intermediate transfer belt 8 without being transferred to the transfer medium P is charged by the cleaning unit 75 and recovered from the first transfer portions by the photosensitive drums 2*a*, 2*b*, 2*c*, and 2*d*.

Figure 4:
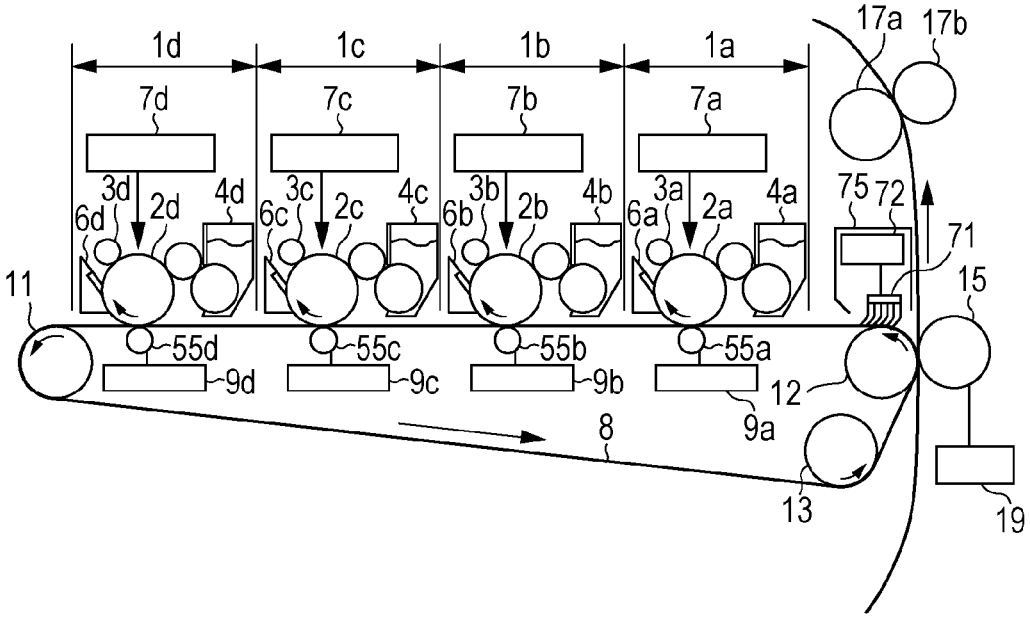
FIG. 4 is a schematic sectional view illustrating an image forming apparatus that includes image forming parts each having a first-transfer voltage source.

The image forming apparatus according to the first embodiment is characterized in that toner images are first-transferred from the photosensitive drums 2*a*, 2*b*, 2*c*, and 2*d* to the intermediate transfer belt 8 without the opposed rollers 5*a*, 5*b*, 5*c*, and 5*d* having voltages applied thereto, unlike in the case of the first transfer rollers 55*a*, 55*b*, 55*c*, and 55*d* illustrated in FIG. 4.

Now, a volume resistivity, a surface resistivity, and a circumferential resistance of the intermediate transfer belt 8 will be described below for describing the characteristics of the image forming apparatus according to the first embodiment. The definition and a method of measuring the circumferential resistance will be described below.

Volume Resistivity and Surface Resistivity of Intermediate Transfer Belt

The intermediate transfer belt 8 according to the first embodiment has a base layer obtained by dispersing carbon in a polyphenylene sulfide (PPS) polymer having a thickness of 100 μm and by being subjected to adjustment of the electrical resistance. Other adoptable polymers include polyimide (PI), polyvinylidene fluoride (PVdF), nylon, polyethylene terephthalate (PET), polybutylene terephthalate (PBT), polycarbonate, polyetheretherketone (PEEK), and polyethylene naphthalate (PEN).

The intermediate transfer belt 8 has a multilayer structure. Specifically, the intermediate transfer belt 8 has a highly resistant acrylic surface layer with a thickness of 0.5 to 3 μm on the outer side of the base layer. The highly resistant surface layer is provided to decrease the difference in amount of current in the longitudinal direction of the second transfer unit, i.e., the difference between the amount of current flowing through a sheet-feeding region of the second transfer unit and the amount of current flowing through a non-sheet-feeding region of the second transfer unit, and to thus obtain a desired performance of the transfer unit in the case of a second transfer of toner images to a small sheet.

Next, a method of producing an intermediate transfer belt will be described. In the first embodiment, an inflation forming method is adopted as the production method. A compound of PPS that is the base material and carbon black that is electric conductive powders or the like are melted and mixed by a twin-shaft kneader. The obtained mixture is extruded by an annular die and thus formed into a belt.

The surface coat layer is formed by spray-coating a ultraviolet curable resin on the surface of the formed endless belt, drying the resin, and then curing the resin with ultraviolet irradiation. The amount of resin used for coating is regulated to be within a range of 0.5 to 3 μm because the coat layer cracks more easily if it is too thick.

Although carbon black is adopted as an electric conductive powder in the first embodiment, the present invention is not limited to any particular additive that is mixed for adjusting the electrical resistance of the intermediate transfer belt 8. Examples of an electric conductive filler that can adjust the resistance include various conductive metal oxides in addition to carbon black. Examples of a non-filler additive for adjusting the resistance include a low-molecular-weight ionic conductor such as metal salts and glycols, an antistatic resin having an ether bond or a hydroxyl in its molecule, or an organic macromolecular compound having electric conductivity.

As the amount of carbon in the belt increases, the belt has a lower resistance. If the belt were to contain an excessively large amount of carbon, the belt would end up with insufficient strength and thus crack more easily. In the first embodiment, the resistance of the belt is lowered to an extent that the strength of the belt falls within a range that is suitable for the image forming apparatus.

The Young's modulus of the intermediate transfer belt 8 according to the first embodiment is approximately 3000 MPa. The Young's modulus E was measured by a method of determining the tensile/elastic modulus of JIS-K7127, and the thickness of the measured specimen was set to 100%.

Table 1 shows relative amounts of carbon in a base material for Belts A to E (referred to as "a relative ratio").

TABLE 1

| | Amount of Carbon (Relative Ratio) | Coat Layer |
|---|---|---|
| Comparative Belt | 0.5 | Absent |
| Belt A | 1 | Present |
| Belt B | 1.5 | Present |
| Belt C | 2 | Present |
| Belt D | 1.5 | Absent |
| Belt E | 2 | Absent |

Table 1 shows the amount of added carbon and the absence or presence of the surface coat layer. For example, Table 1 shows that the amount of carbon in Belt B is 1.5 times that in Belt A, and the amount of carbon in Belt C is two times that in Belt A. Belt A, Belt B, and Belt C include surface coat layers, while Belt D and Belt E are single-layer belts. Belt B and Belt D have the same relative ratio of carbon. Belt C and Belt E also have the same relative ratio of the amount of carbon.

For comparison, a comparative belt made of polyimide was also prepared by changing the relative ratio of carbon and by being subjected to resistance adjustment. The comparative belt has a relative ratio of carbon of 0.5 and a volume resistivity of $10^{10}$ to $10^{11}$ Ωcm. The comparative belt has a resistance that is general for typical intermediate transfer belts.

Measurement results of the volume resistivity and the surface resistivity for the comparative belt and Belts A to E are shown below.

Measurement was performed on the comparative belt and Belts A to E by use of Hiresta UP (MCP-HT450) that is a resistivity meter produced by Mitsubishi Chemical Analytech Co., Ltd. Table 2 shows the measurement results of the volume resistivity and the surface resistivity (of the outer surface of each belt). The measurement was performed by a measurement method of JIS-K6911 and by using a conductive rubber as an electrode so that the electrode and the surface of each belt could be in favorable contact with each other. The measurement was performed by applying each of voltages of 10 V and 100 V to each belt for 30 seconds.

TABLE 2

| | Volume Resistivity [Ωcm] | | Surface Resistivity [Ω/square] | |
|---|---|---|---|---|
| Applied Voltage | 10 V | 100 V | 10 V | 100 V |
| Comparative Belt | over | $1.0 \times 10^{10}$ | over | $1.0 \times 10^{10}$ |
| Belt A | over | $2.0 \times 10^{12}$ | over | $1.0 \times 10^{12}$ |
| Belt B | $1.0 \times 10^{12}$ | under | $4.0 \times 10^{11}$ | $2.0 \times 10^{8}$ |
| Belt C | $1.0 \times 10^{10}$ | under | $5.0 \times 10^{10}$ | under |
| Belt D | $5.0 \times 10^{6}$ | under | $5.0 \times 10^{6}$ | under |
| Belt E | under | under | under | under |

When a voltage of 100 V was applied to the comparative belt, the volume resistivity was determined to be $1.0 \times 10^{10}$ Ωcm and the surface resistivity was determined to be $1.0 \times 10^{10}$ Ω/square. However, when a voltage of 10 V was applied to the comparative belt, the current flowing through the belt was too small for the meter to determine the volume resistivity, and thus the meter showed "over".

On the other hand, when a voltage of 100 V was applied to each of Belts B, C, and D, the meter showed "under", which indicates that, due to the low resistance of the belt, the current flowing through the low-resistant belt was too large for the meter to determine the volume resistivity. When a voltage of 100 V was applied to Belt B, the surface resistivity was determined to be $2.0\times10^8$ Ω/square, whereas when a voltage of 100 V was applied to each of Belts C and D, the meter showed "under".

As shown in Table 2, when a voltage of 10 V was applied to Belt A, the meter failed to determine the volume resistivity and the surface resistivity. The surface resistivity of Belt A that was obtained when a voltage of 100 V was applied to Belt A is higher than that of the comparative belt obtained under the same conditions. This is due to the presence of the coat layer. Accordingly, it is found that Belt A that has a highly resistant surface coat layer has a higher electrical resistance than the comparative belt that has no surface coat layer.

By comparing Belt B and Belt D, and Belt C and Belt E, it is found that the presence of the coat layer increases the resistance. In addition, by comparing Belt B and Belt C, and Belt D and Belt E, it is found that the increase in the amount of carbon lowers the resistance. The meter was unable to determine the resistivity of Belt E under all the conditions since the resistance of Belt E was too low.

The intermediate transfer belt employed in the first embodiment is required to have a volume resistivity or a surface resistivity that falls within a range of values denoted by "under" in Table 2. For this reason, measurement on the resistance of the intermediate transfer belt was performed not by using the volume resistivity and the surface resistivity but by a different way. The resistance of the intermediate transfer belt 8 measured according to the different determination is the circumferential electrical resistance of the intermediate transfer belt.

Method of Determining Circumferential Resistance of Intermediate Transfer Belt

Figure 2A:
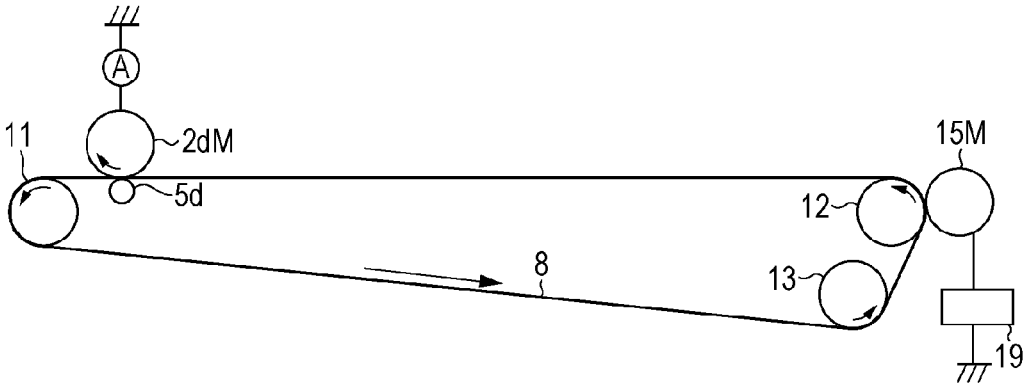
FIGS. 2A and 2B are schematic sectional views illustrating a method of measuring a circumferential resistance of an intermediate transfer belt according to an embodiment of the present invention.
Figure 2B:
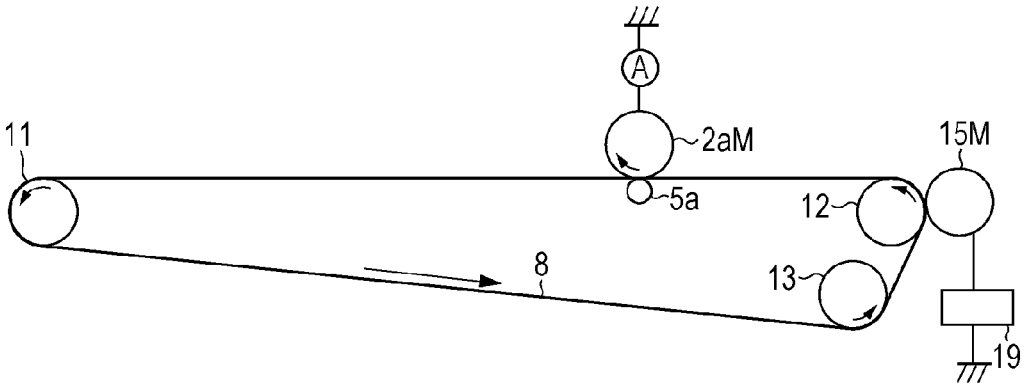

In the first embodiment, the resistance of the low-resistant belt is measured by a method illustrated in FIGS. 2A and 2B. As shown in FIG. 2A, when a certain voltage (measurement voltage) is applied to an outer roller 15M (first metal roller) from a high-voltage source (the transfer power source 19 is used herein), a current meter, which is connected to a photosensitive drum 2*d*M (second metal roller) of the image forming part 1*d* and which serves as a current detecting unit, detects the current that has flowed thereto. The electrical resistance of the intermediate transfer belt 8 between a portion that is in contact with the outer roller 15M and a portion that is in contact with the photosensitive drum 2*d*M is determined on the basis of the detected current. Specifically, the electrical resistance of the belt is determined by measuring the current flowing in the circumferential direction (rotational direction) of the intermediate transfer belt 8 and then dividing the measurement voltage by the measured current. Here, for eliminating any effects of resistance other than that of the intermediate transfer belt, the outer roller 15M and the photosensitive drum 2*d*M that are simply made of metal (aluminum) are used. To indicate that they are made of metal, M is added at the end of each reference sign. In the first embodiment, the distance between the portion that is in contact with the outer roller 15M and the portion that is in contact with the photosensitive drum 2*d*M on the upper surface side of the intermediate transfer belt is 370 mm, while that on the lower surface side of the intermediate transfer belt is 420 mm.

Figure 3A:
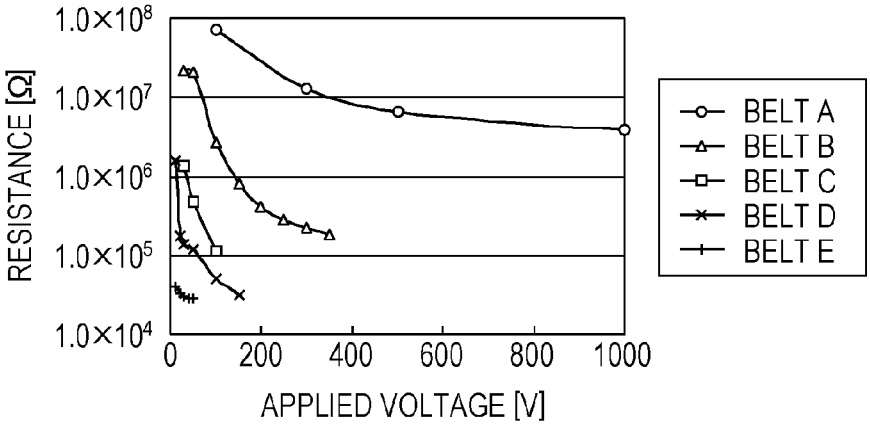
FIGS. 3A and 3B are graphs showing the measurement results of the circumferential resistance of the intermediate transfer belt.

FIG. 3A shows the measurement results of the resistances of Belts A to E obtained by applying different voltages in the above method. With this measurement method, the resistance in the circumferential direction that is the rotational direction of the intermediate transfer belt is measured. For this reason, the resistance of the intermediate transfer belt obtained in this method is referred to as the circumferential resistance [Ω] in the first embodiment.

All the belts demonstrate a tendency to gradually lower the resistance as the applied voltage is increased. This is characteristic of belts formed by dispersing carbon in resin.

The structure of FIG. 2B is different from that of FIG. 2A only with regard to the position of the current meter. The resistance measurement results are almost the same as those in FIGS. 3A and 3B. Thus, with the measuring method according to the first embodiment, the resistance is not changed by the position of the current meter.

With the method shown in FIGS. 2A and 2B, the resistances of Belts A to E were successfully determined, while the resistance of the comparative belt failed to be determined. This is because the comparative belt is a belt that is employed in an image forming apparatus which includes the first transfer rollers 55*a*, 55*b*, 55*c*, and 55*d* shown in FIG. 4 that are connected to the corresponding voltage sources.

In the image forming apparatus shown in FIG. 4, the intermediate transfer belt has a high volume resistivity and a high surface resistivity so that the adjacent voltage sources are not affected by (interfered with) the currents flowing therethrough via the intermediate transfer belt. The comparative belt has such a resistance that the first transfer rollers 55*a*, 55*b*, 55*c*, and 55*d* do not interfere with one another even after having voltages applied thereto. The comparative belt is less likely to allow the current to flow in the circumferential direction. A belt such as the comparative belt is defined as a highly resistant belt, while a belt, such as any one of Belts A to E, that allows the current to flow in the circumferential direction is defined as an electric conductive belt.

Figure 3B:
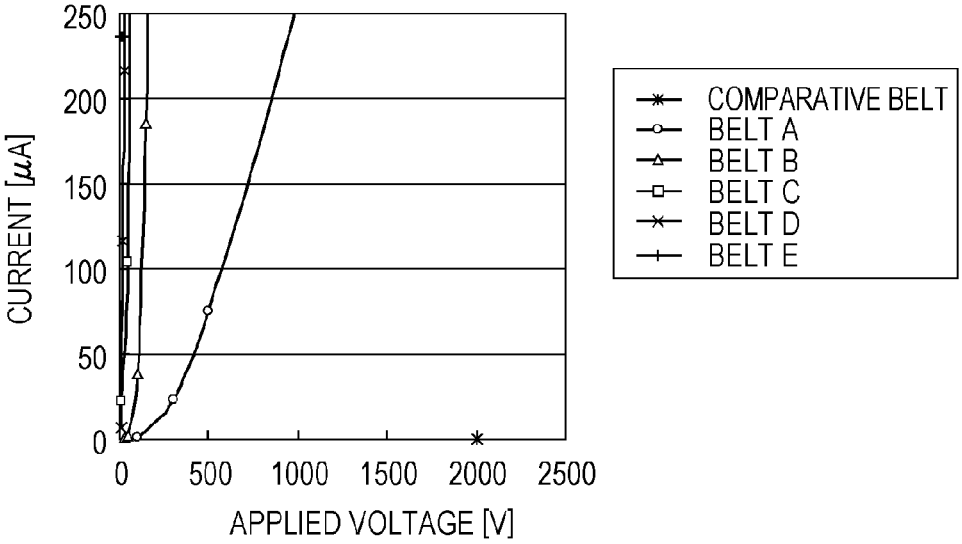

In FIG. 3B, the values of the current measured by the measurement method shown in FIG. 2A are plotted without being converted. The ordinate in FIG. 3A represents the resistance [Ω] that is obtained by dividing each measured current shown in FIG. 3B by the applied voltage.

As shown in FIG. 3B, the comparative belt did not allow any current to flow therethrough in the circumferential direction even when having a voltage of 2000 V applied thereto. On the other hand, as shown in FIG. 3B, Belts A to E each allowed a current to flow therethrough at an amount of 50 μA or larger when having a voltage of 500 V or lower applied thereto. In the image forming apparatus according to the first embodiment, the belt used as the intermediate transfer belt has a circumferential resistance of $10^4$ to $10^8$Ω. Since the intermediate transfer belt has a circumferential resistance of $10^4$ to $10^8$Ω, the image forming apparatus according to the first embodiment allows a current to easily flow in the circumferential direction of the belt and thus has a desired first transfer performance of the transfer unit.

Figure 5A:
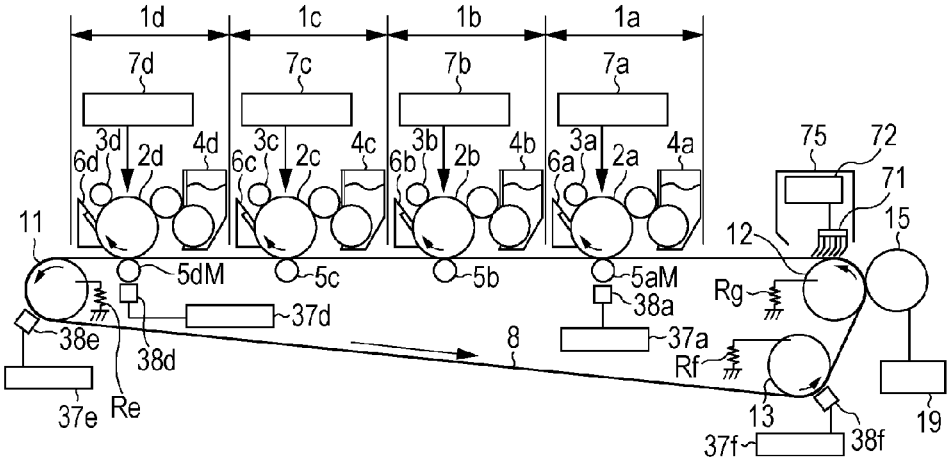
FIGS. 5A and 5B are schematic sectional views illustrating a method of measuring the potential of the intermediate transfer belt.
Figure 5B:
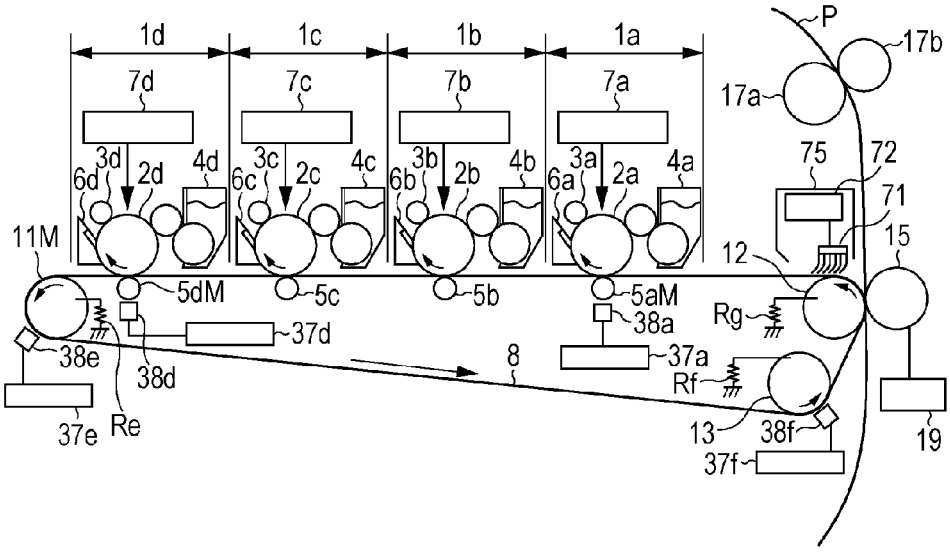

Next, the potential of the belt surface of the intermediate transfer belt 8 that has a circumferential resistance of $10^4$ to $10^8$Ω will be described. FIGS. 5A and 5B illustrate a method of measuring the potential of the belt surface. In FIGS. 5A and 5B, four surface voltmeters 37*a*, 37*d*, 37*e*, and 37*f* are used to measure potentials at four points. Reference signs 5*d*M and 5*a*M in FIGS. 5A and 5B denote metal rollers for measurement.

The surface voltmeter 37*a* and a measurement probe 38*a* are used to measure the potential of the first transfer roller 5*a*M (metal roller) of the image forming part 1*a*. Here, a surface voltmeter of MODEL 344 produced by Trek Japan KK is used for the measurement. The potential of the inner surface of the intermediate transfer belt may be determined with this method because the metal roller has the same potential as that of the inner surface of the intermediate transfer belt. In the same manner, the surface voltmeter 37*d* and a measurement probe 38*d* are used to measure the potential of the first transfer roller 5*d*M (metal roller) of the image forming part 1*d*, and thus the potential of the inner surface of the intermediate transfer belt is determined.

The surface voltmeter 37*e* and a measurement probe 38*e* are opposite a driving roller 11M and are used to measure the potential of the outer surface of the intermediate transfer belt. The surface voltmeter 37*f* and a measurement probe 38*f* are opposite the tension roller 13 and are used to measure the potential of the outer surface of the intermediate transfer belt. The driving roller 11M, the opposing roller for second transfer 12, and the tension roller 13 are respectively connected to electrical resistors Re, Rg, and Rf.

After measurement of the potential of the intermediate transfer belt by this measurement method, it is found that there is almost no potential difference between the different measurement positions and thus the intermediate transfer belt has an almost uniform belt potential. Thus, the belt used in the first embodiment can be said to have a conductivity although it has a certain level of resistance.

Figure 6A:
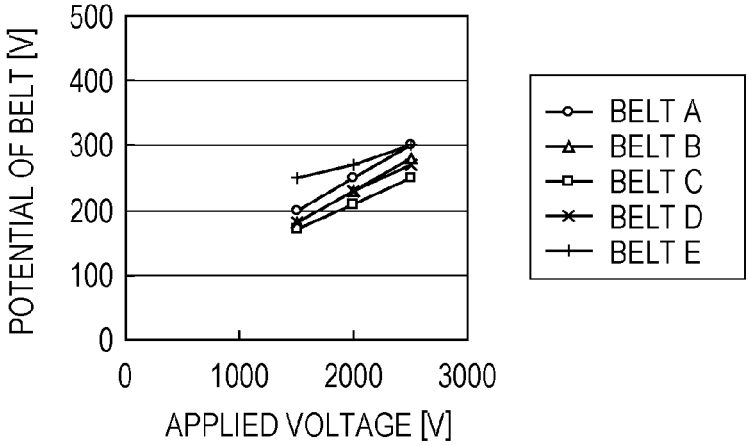
FIGS. 6A to 6C are graphs showing measurement results of the potential of the intermediate transfer belt.
Figure 6B:
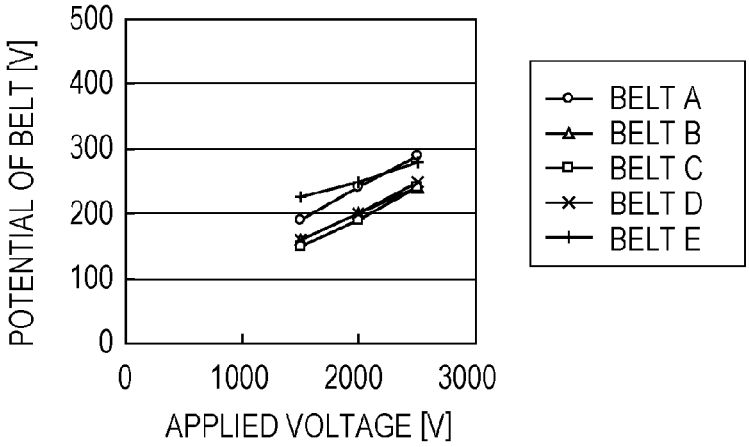
Figure 6C:
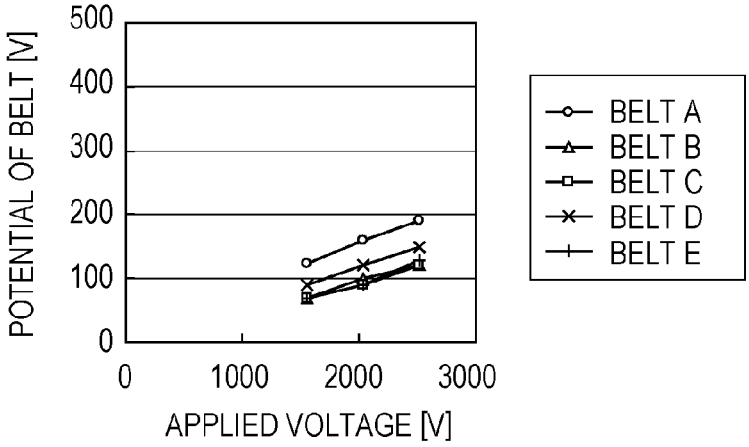

FIGS. 6A to 6C show the measurement results of the potential of the intermediate transfer belt. FIG. 6A shows the results measured by the resistors Re, Rf, and Rg having a resistance of 1 GΩ. The abscissa represents the voltage applied from the transfer power source 19 and the ordinate represents the potential of each of Belts A to E.

In the same manner, FIG. 6B shows the results measured by the resistors Re, Rf, and Rg having a resistance of 100 MΩ, and FIG. 6C shows the results measured by the resistors Re, Rf, and Rg having a resistance of 10 MΩ.

In each of Belts A to E, the potential of the belt surface rises as the applied voltage becomes higher, while the potential of the belt surface decreases as the resistance is lowered in the order of 1 GΩ, 100 MΩ, and 10 MΩ. Herein, the resistors Re, Rf, and Rg are set to have the same resistance. If, however, the resistance of one of the resistors is lowered, the potential of the belt surface is lowered in accordance with the lowered resistance.

The above method cannot be used for measuring the potential of the belt surface of an intermediate transfer belt that has such a resistance that the current is not allowed to flow in the circumferential direction, such as the comparative belt. In addition, the measurement probes cannot be disposed in the structure, as shown in FIG. 4, in which each first transfer roller has a voltage applied thereto from the power source 9 dedicated thereto. Also, different positions in the circumferential direction of the belt have different potentials. For this reason, the potential of the belt surface of each first transfer portion cannot be determined through measurement by the measurement probes that are disposed so as to be opposite the corresponding support rollers.

Referring now to FIGS. 7A to 7D, a description will be given of how a toner image is transferred from the photosensitive drum to the intermediate transfer belt in the structure according to the first embodiment.

Figure 7A:
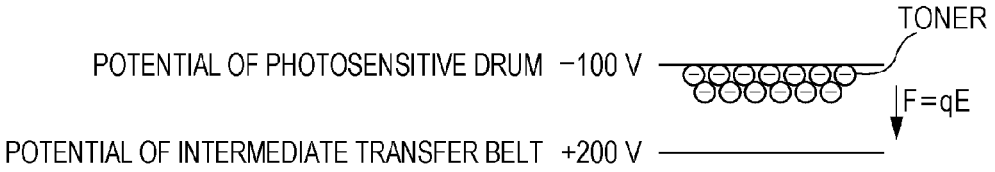
FIGS. 7A to 7D illustrate a first transfer according to an embodiment of the present invention.

FIG. 7A illustrates the relationship of potentials in a first transfer portion. In the example shown in FIG. 7A, the potential of a toner portion (image portion) of the photosensitive drum is −100 V and the surface potential of the intermediate transfer belt is +200 V. The toner that has been developed on the photosensitive drum and has a charge quantity q is first-transferred by applying a force F thereto that causes the toner to shift toward the intermediate transfer belt. The force F is generated by an electric field E defined by the potential of the photosensitive drum and the potential of the intermediate transfer belt.

Figure 7B:
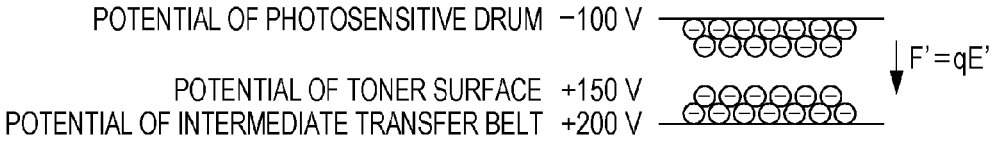

FIG. 7B illustrates a multilayer transfer. A multilayer transfer involves a first transfer of a toner image with a first color so that the toner image is superposed on another toner image with a different color that has been first-transferred to the intermediate transfer belt. FIG. 7B shows an example where the toner is negatively charged and the surface potential of toner is changed to +150 V due to the toner that has been transferred to the intermediate transfer belt. In this case, the toner on the photosensitive drum is first-transferred by applying a force F' thereto to shift the toner toward the intermediate transfer belt, the force F' being generated by an electric field E' defined by the potential of the photosensitive drum and the surface potential of the toner.

Figure 7C:
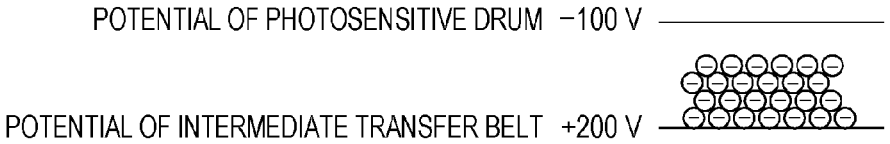

FIG. 7C illustrates a state where the multilayer transfer is complete.

As described above, the first transfer of toner is affected by the quantity of charge in the toner and the potential difference between the photosensitive drum and the intermediate transfer belt. Thus, the potential of the intermediate transfer belt has to be a predetermined value or larger so that the intermediate transfer belt maintains a favorable first transfer performance of the transfer unit.

With the above conditions that are required for the first embodiment taken into consideration, it is found that the potential of the intermediate transfer belt that is required to first-transfer the toner developed on the photosensitive drum is 200 V or larger.

Figure 7D:
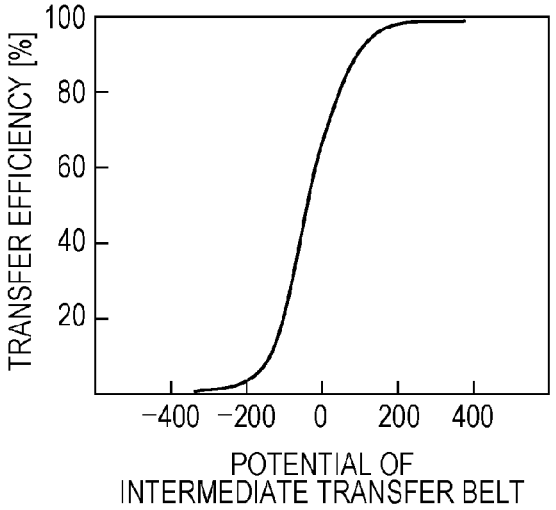

FIG. 7D is a graph in which the abscissa represents the potential of the intermediate transfer belt and the ordinate represents a transfer efficiency. The transfer efficiency is an index of a transfer performance that indicates what percentage of the toner that has been developed on the photosensitive drum is transferred to the intermediate transfer belt. If the transfer efficiency is 95% or higher, it is usually determined that the toner is well transferred. FIG. 7D shows that, when the potential of the intermediate transfer belt is 200 V or higher, the transfer efficiency is 98% or higher and thus the toner is well transferred.

At this time, the image forming parts 1*a*, 1*b*, 1*c*, and 1*d* have the same potential difference between the intermediate transfer belt and the corresponding photosensitive drums. Specifically, the first transfer portions of the image forming parts 1*a*, 1*b*, 1*c*, and 1*d* each have a potential difference of 300 V, that is the difference between the potential of −100 V of each photosensitive drum and the potential of +200 V of the intermediate transfer belt. This potential difference is required for the multilayer transfer of toners of three colors (the amount of toner is 300%, provided that the amount for solid printing of a single color is denoted by 100%), and is almost equivalent to that in the known structure for first transfers in which each first transfer roller is applied with a first transfer bias. Although image forming apparatuses usually have four colors, they do not usually form an image containing toners in an amount of 400%. Thus, as long as the maximum amount of toner is set to be within 210 to 280%, the image forming apparatuses sufficiently form full-color images.

As described above, in the first embodiment, a first transfer is performed by allowing a current to flow in the circumferential direction of the intermediate transfer belt so that the surface potential of the intermediate transfer belt is a predetermined potential. In other words, the transfer power source 19 causes a current to flow from the second transfer roller 15 to the multiple photosensitive drums via the intermediate transfer belt, and thus a first transfer is performed. In the first embodiment, a single transfer power source enables a first transfer and a second transfer by applying a voltage to the second transfer roller 15, which is a second transfer component. A second transfer involves transferring toner that has been first-transferred to the intermediate transfer belt 8, to a transfer medium by Coulomb force as in the case of a first transfer. Under the conditions according to the first embodiment, if wood-free paper (a basis weight of 75 g/m$^2$) is used for a transfer medium, the voltage required for the second transfer is 2 kV or higher.

Figure 8A:
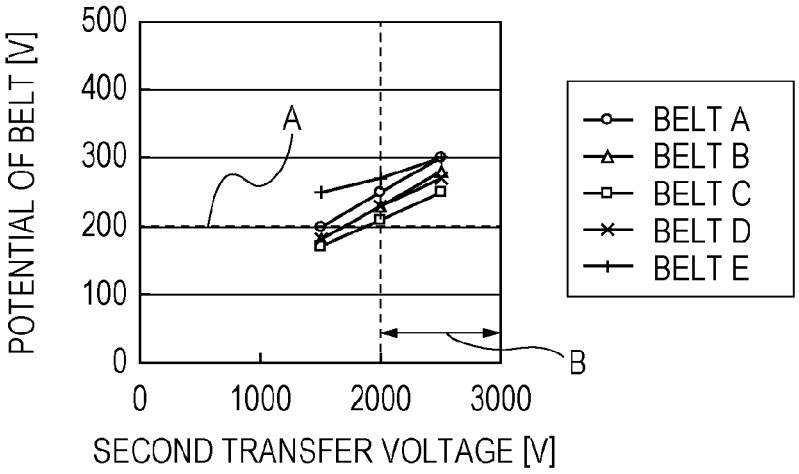
FIGS. 8A to 8C are graphs that indicate conditions that the potential of the intermediate transfer belt has to satisfy for first transfers and second transfers.
Figure 8B:
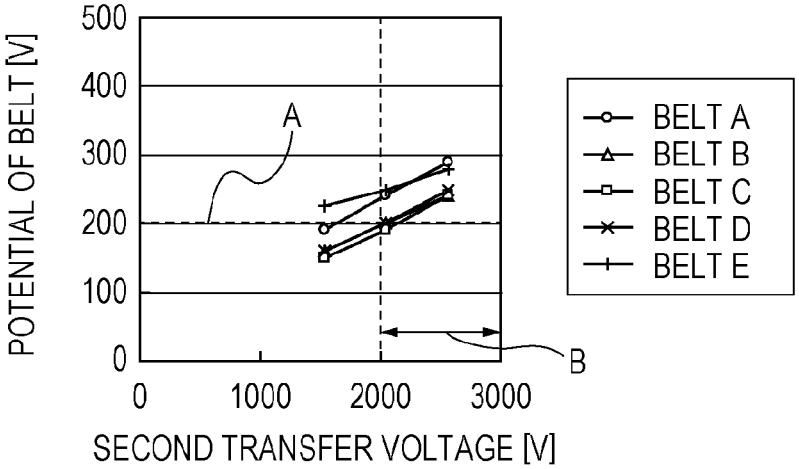
Figure 8C:
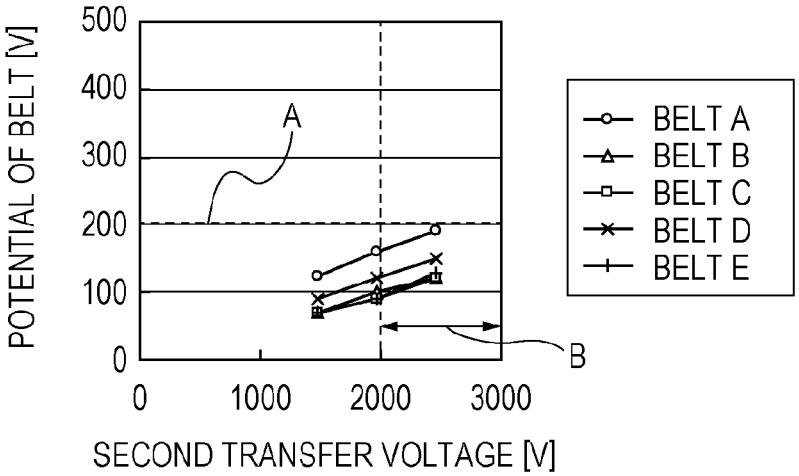

FIGS. 8A, 8B, and 8C are drawings equivalent to FIGS. 6A, 6B, and 6C but a condition required for satisfying first transfers and second transfers is additionally shown in the potential of the intermediate transfer belt. Dotted lines A shown in FIGS. 8A, 8B, and 8C indicate the potential of the intermediate transfer belt that is required for first transfers. Arrows B in FIGS. 8A, 8B, and 8C denote a range of the voltage to be set for second transfers. FIG. 8A shows the results measured by the resistors having a resistance of 1 GΩ. FIG. 8B shows the results measured by the resistors having a resistance of 100 MΩ. FIG. 8C shows the results measured by the resistors having a resistance of 10 MΩ. As shown in FIGS. 8A and 8B, in the case where the resistance is 1 GΩ or 100 MΩ, the surface of the intermediate transfer belt has a predetermined potential (200 V in the first embodiment) or higher when being applied with a second transfer voltage of a certain value or higher (2000 V or higher). In the first embodiment, the surface potential of the intermediate transfer belt that is a predetermined potential or higher suffices for first transfers and second transfers. As shown in FIG. 8C, in the case where the resistance is 10 MΩ, a second transfer voltage that is higher than 2000 V is required. A second transfer is made possible with a resistance of 10 MΩ if the second transfer voltage is increased. In this case, however, a power source with a larger capacity is needed since a current is actually made to flow to the support rollers.

Figure 9:
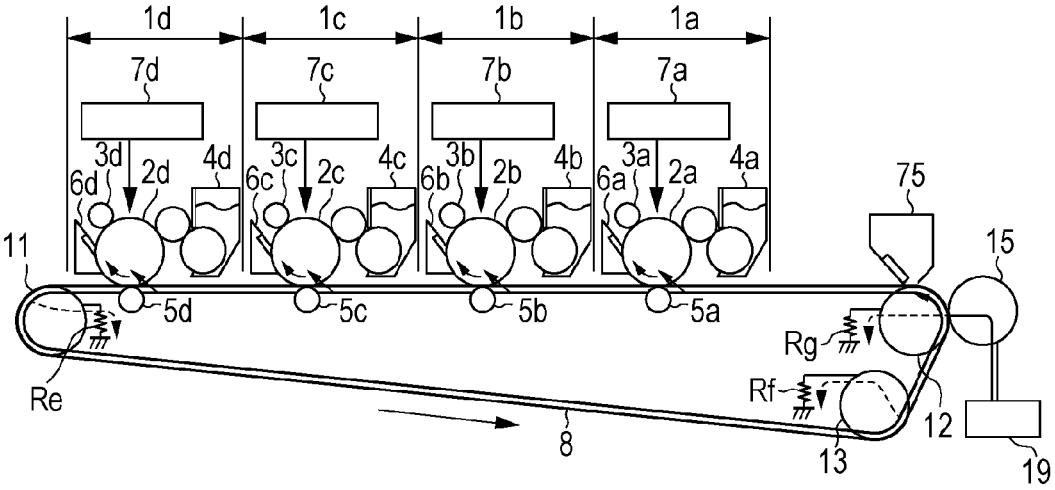
FIG. 9 is a schematic sectional view illustrating a current flowing in a rotational direction of the intermediate transfer belt.

FIG. 9 schematically illustrates the current that flows from the second transfer roller 15 to the intermediate transfer belt 8. FIG. 9 illustrates a state where the resistors Re, Rg, and Rf are connected to the support rollers 11, 12, and 13. Bold solid arrows shown in FIG. 9 indicate currents that flow from the transfer power source 19 toward the photosensitive drums. Bold dotted arrows indicate currents that flow to the support rollers 11, 12, and 13. As described above, a larger amount of current flows when the resistors Re, Rf, and Rg have a low resistance. Since the potential difference is almost the same between the intermediate transfer belt and the photosensitive drums of the image forming parts 1*a*, 1*b*, 1*c*, and 1*d*, almost the same amount of current flows to each photosensitive drum. Nevertheless, the amount of current that flows to the photosensitive drums of the image forming parts may vary to some extent if the capacitance varies due to the variance in thickness between the photosensitive layers of the photosensitive drums. In the first embodiment, the thickness of the photosensitive layer is within a range of 10 to 20 μm in a period between before being used and after being subjected to an endurance test for sheet feeding.

If the first transfer portions are separated from the second transfer unit by a distance that is large enough, an optimum transfer voltage for a first transfer may be applied to the second transfer roller 15 in the first transfer, if needed. Then, at the timing when a second transfer is to be performed after the first transfer is complete, the voltage may be switched to an optimum transfer voltage for the second transfer.

A voltage may be applied from the transfer power source 19 to the opposing roller for second transfer 12, instead of to the second transfer roller 15. In this case, the opposing roller for second transfer 12 serves as a current supply member. At the timing when a second transfer is to be performed after the first transfer is complete, the second transfer is performed if a voltage with a polarity that is the same as a polarity with which the toner is normally charged is applied from the transfer power source 19 to the opposing roller for second transfer 12.

Figure 10:
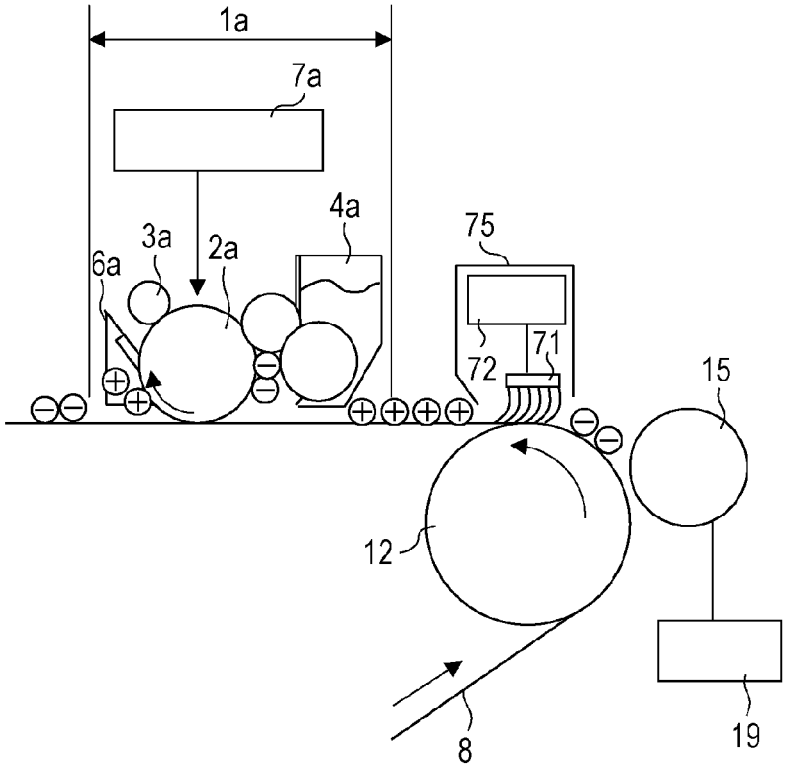
FIG. 10 illustrates a method of transferring a residual toner remaining on the intermediate transfer belt to a photosensitive drum.

A residual toner remaining on the intermediate transfer belt 8 is transferred to each photosensitive drum 2, and recovered from the photosensitive drum 2 by the corresponding drum cleaning device 6. A detailed description will be given with reference to FIG. 10.

A residual toner that has not been transferred to a transfer medium in a second transfer is charged by a cleaning brush 71, which serves as a toner charging portion, of the cleaning unit 75. Since a voltage with a polarity that is opposite to a polarity with which the toner is normally charged is applied to the cleaning brush 71 from the cleaning power source 72, the residual toner is charged with a polarity that is opposite to a polarity with which the toner is normally charged. The charged residual toner is transferred to the photosensitive drum 2 in the first transfer portion. The toner that has been transferred to the photosensitive drum 1*a* is recovered by the drum cleaning device 6*a*.

In a case of consecutively forming images, while a residual toner is transferred from the intermediate transfer belt to each photosensitive drum, a subsequent toner image is concurrently first-transferred from each photosensitive drum to the intermediate transfer belt 8. In the first embodiment, the toner in the developing unit 4*a* is charged with a negative polarity, which is opposite to the polarity of the residual toner that has completely passed through the cleaning brush 71.

In the first embodiment, when the residual toner is transferred from the intermediate transfer belt to each photosensitive drum, a voltage is applied to the second transfer roller 15 so that the potential of the intermediate transfer belt is changed to be positive (so that the potential of the intermediate transfer belt has a polarity that is opposite to the polarity with which toner is normally charged).

In addition, a positive voltage is also applied to the cleaning brush 71 so that the residual toner is positively charged. Thus, a current flows in the circumferential direction of the intermediate transfer belt 8 from the cleaning brush 71 that is applied with the voltage.

Figure 11:
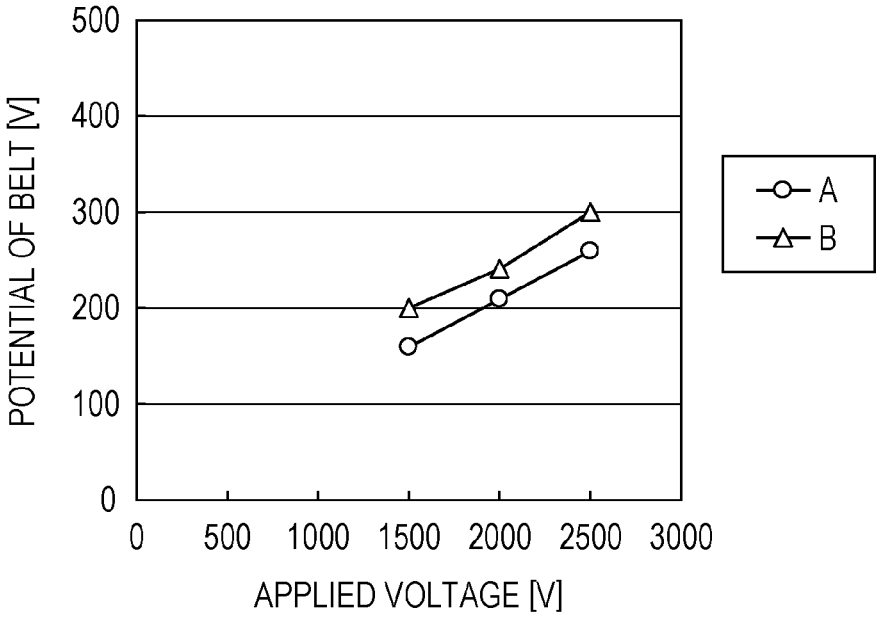
FIG. 11 is a graph showing the belt potential and the voltage applied from a transfer power source and a charging power source.

FIG. 11 shows the relationship between the voltage applied to the second transfer roller 15, which serves as the current supply member, and the potential of the belt. Line A indicates a case where no voltage is applied to the cleaning brush 71 and a voltage is only applied to the current supply member. Line B indicates a case where voltages are applied to both the current supply member and the cleaning brush 71.

As shown in FIG. 11, the potential of the intermediate transfer belt for the case where a voltage is applied to the cleaning brush 71 is higher than that of the other case, even though the same voltage is applied to the second transfer roller for both cases. This is because, not only a current from the second transfer roller 15, but also a current from the cleaning brush 71 flows in the circumferential direction of the intermediate transfer belt 8.

An increase in amount of current that flows in the circumferential direction of the intermediate transfer belt 8 causes the potential of the intermediate transfer belt 8 to rise accordingly. As described above, the first and second transfer performance of the transfer unit is maintained by regulating the surface potential of the intermediate transfer belt 8 to be 200 V. For this reason, if the potential cannot be maintained at 200 V, the first transfer portion may have a lower efficiency in the first transfer and the residual toner transfer. In addition, if the surface potential becomes greater than or equal to a desired potential, the efficiency with which a toner image from the intermediate transfer belt 8 is second-transferred to a transfer medium is lowered.

The comparative belt used in the image forming apparatus illustrated in FIG. 4 does not have the above problem. This is because the comparative belt has a high volume resistivity and a high charge decay rate and thus the potential of the intermediate transfer belt decays while the intermediate transfer belt moves through a distance from the cleaning brush 71 to the first transfer portion.

To solve the above problem, the voltages that are output from the transfer power source 19 and the cleaning power source 72 may be regulated in such a manner that the surface potential of the intermediate transfer belt 8 does not exceed 200 V. In this case, however, complex voltage regulation is required.

Figure 12A:
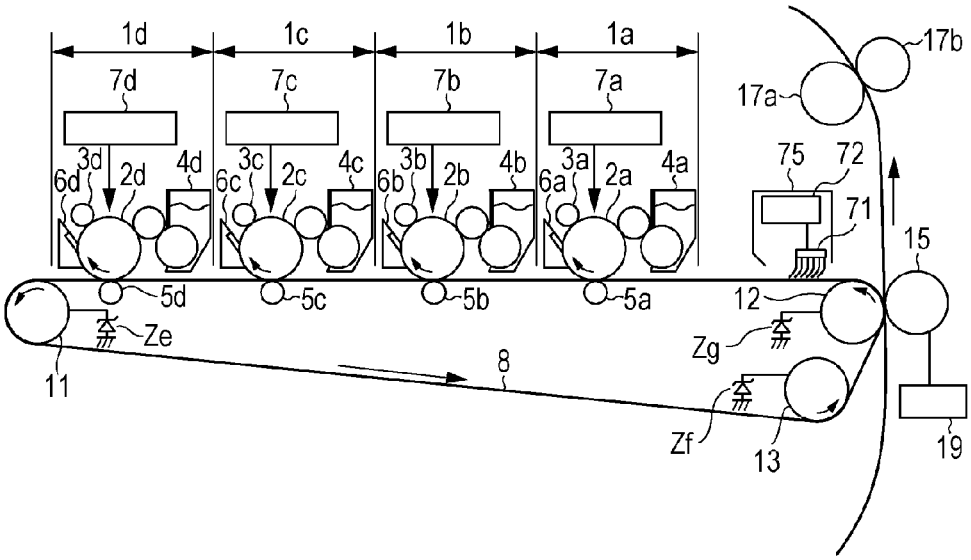
FIGS. 12A and 12B each illustrate a state where support members are each connected to a constant-voltage element.
Figure 12B:
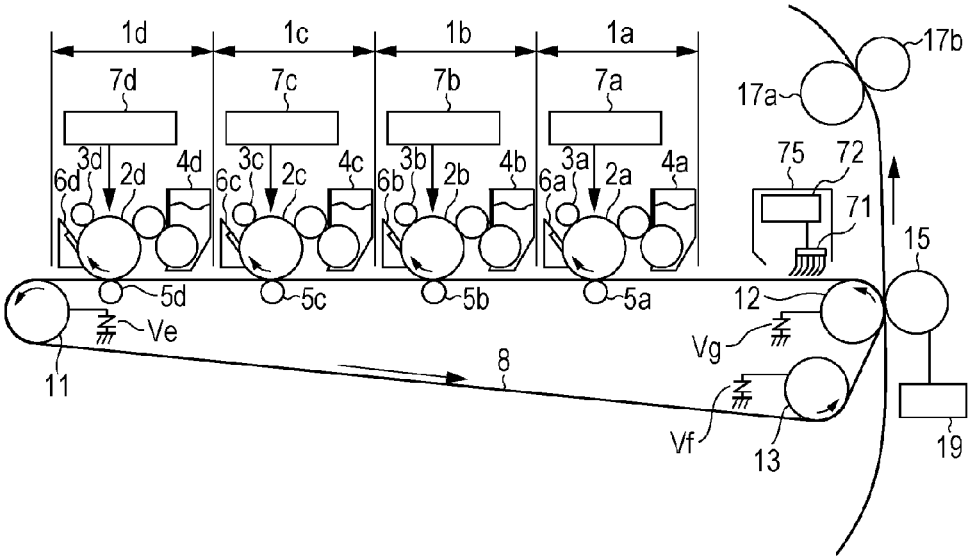
Figure 13A:
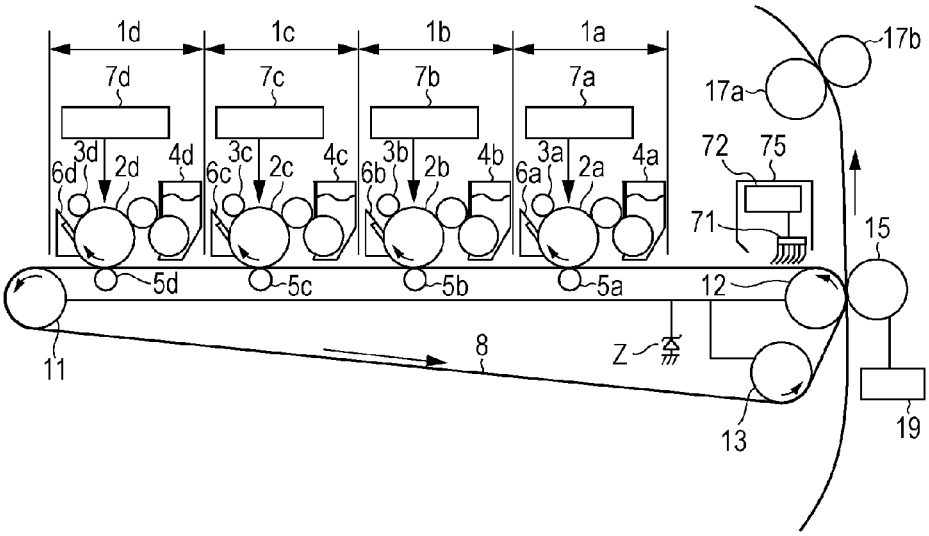
FIGS. 13A and 13B each illustrate a state where the support members are connected to a common constant-voltage element.
Figure 13B:
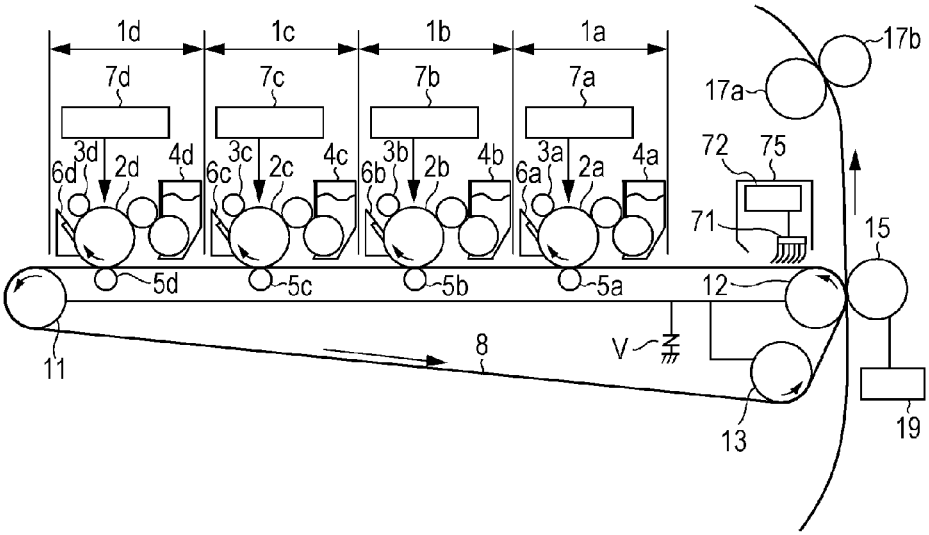

In the first embodiment, to prevent the first and second transfer performance of the transfer unit from being degraded, the resistors Rg, Re, and Rf that are connected to the multiple support rollers are used instead of resistance elements, to serve as constant-voltage elements that have a predetermined voltage threshold. Specifically, the support rollers are grounded via zener diodes or varistors, which serve as constant-voltage elements. FIG. 12A illustrates a state where zener diodes are connected to the support rollers. FIG. 12B illustrates a state where varistors are connected to the support rollers. FIG. 13A illustrates a state where a common zener diode is connected to the support rollers. FIG. 13B illustrates a state where a common varistor is connected to the support rollers.

Figure 14:
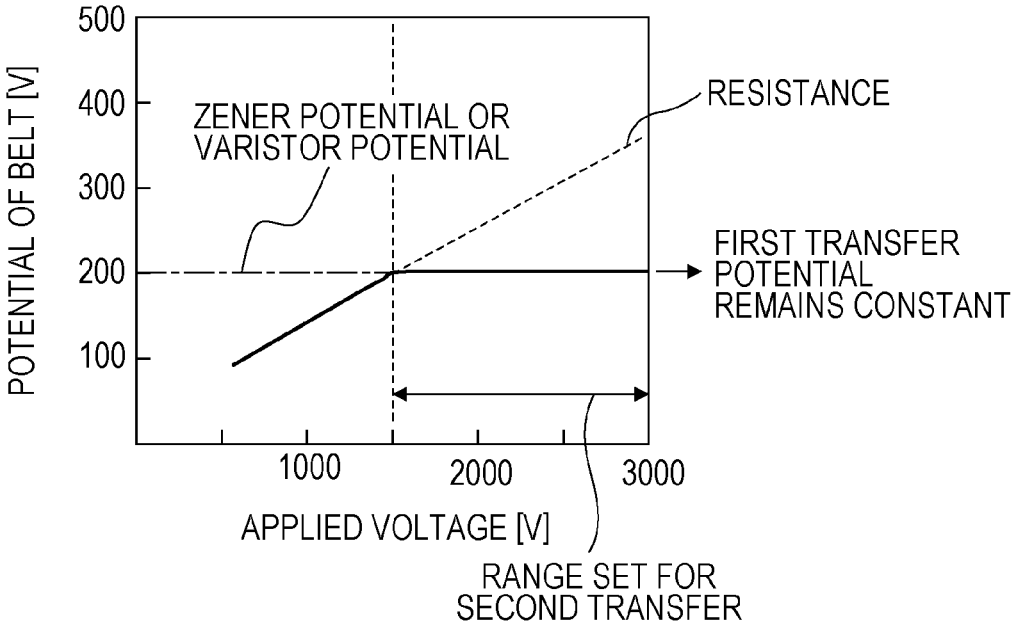
FIG. 14 illustrates an effect of constant-voltage elements according to an embodiment of the present invention.

FIG. 14 shows the potential of the intermediate transfer belt in a state where the support rollers are grounded via zener diodes or varistors and at the timing when voltages are simultaneously applied to the second transfer roller 15 and the cleaning brush 71. For comparison purpose, a dotted line is also shown for a case where resistance elements are connected to the support rollers. In the case where the resistance elements are connected to the support rollers and an increasingly high voltage is applied to the second transfer roller 15 and the cleaning brush 71, the potential of the intermediate transfer belt rises proportionally to the applied voltage.

The situation is different, however, in the case where zener diodes or varistors are connected to the support rollers. Once the potential of the intermediate transfer belt exceeds a zener potential or a varistor potential, the current starts flowing to the support rollers. Thus, the potential of the intermediate transfer belt 8 is kept at the zener potential or the varistor potential. For this reason, the belt potential is prevented from exceeding the zener potential or the varistor potential even when an increasingly high voltage is applied. Thus, the belt potential is maintained at a constant value and thus the first transfer performance of the transfer unit can be made stable.

Considering the environmental effects, the zener potential or the varistor potential is set at a predetermined potential of 200 V. With this setting, the first and second transfer performance of the transfer unit can be made stable. At the same time, the voltage to be applied to the second transfer roller 15 and the voltage to be applied to the cleaning brush 71 can be optimized independently of each other.

Supplying a current from the current supply member in the rotational direction of the intermediate transfer belt eliminates the need for providing the multiple first transfer portions with the voltage sources. Even in the case where the toner-charging member supplies a current to the intermediate transfer belt, the potential of the intermediate transfer belt can be maintained at a predetermined potential by the constant-voltage elements connected to the support rollers.

Although a brush is employed as the charging member in the first embodiment, the present invention is not limited to this. A roller may be employed instead, as long as the roller allows a residual toner to be charged with a desired polarity. Alternatively, a combination of a brush and a roller may be employed.

The intermediate transfer belt according to the first embodiment is formed by adding carbon into PPS so as to be conductive, but the intermediate transfer belt is not limited to this. Other resins or metals may bring about effects that are similar to those of the first embodiment as long as the resins or metals have an equivalent conductivity. The intermediate transfer belt according to the first embodiment has a single layer or two layers. However, an intermediate transfer belt that has three layers or more, including an elastic layer or the like, may bring about similar effects as long as the intermediate transfer belt has the circumferential resistance described above.

The intermediate transfer belt having two layers is produced by forming the base layer and then forming the surface coat layer that coats the surface of the base layer. However, the method of producing the intermediate transfer belt is not limited to this and the intermediate transfer belt may be, for example, formed integrally, as long as the resistance satisfies the above conditions.

The current supply member may be a member other than the second transfer roller 15 and may be a member that comes into contact with the intermediate transfer belt 8.

Second Embodiment

In the first embodiment, a structure is described that prevents the surface potential of the intermediate transfer belt 8 from rising due to an excessive increase in the amount of current that flows in the circumferential direction of the intermediate transfer belt 8. The second embodiment, on the other hand, is made to solve problems that would possibly occur when the surface potential of the intermediate transfer belt 8 is lowered.

In the image forming apparatus, if a first transfer of an n-th image and a second transfer of an (n−1)-th image are concurrently performed as in the case of consecutively forming images, the surface potential of the intermediate transfer belt 8 may be lowered. If the surface potential of the intermediate transfer belt 8 is greatly lowered, the first and second transfer performance of the transfer unit may be degraded.

In the second embodiment, a structure is described in which the potential of the belt surface of the intermediate transfer belt 8 is maintained while a transfer medium is passing through the second transfer unit. Note that components and structures described in the first embodiment are not described herein, such as the structure of the image forming apparatus.

When a transfer medium P is passing through the second transfer unit in which the second transfer roller 15 is used as the current supply member, the potential of the intermediate transfer belt 8 may fail to be maintained at a predetermined value. This is because the amount of current supplied from the current supply member to the intermediate transfer belt 8 decreases with the presence of the high-resistance transfer medium P. With the decrease in amount of current, the surface potential of the intermediate transfer belt 8 may be lowered and the performance of each first transfer portion in the case of first transfers of toner may be degraded.

Figure 15A:
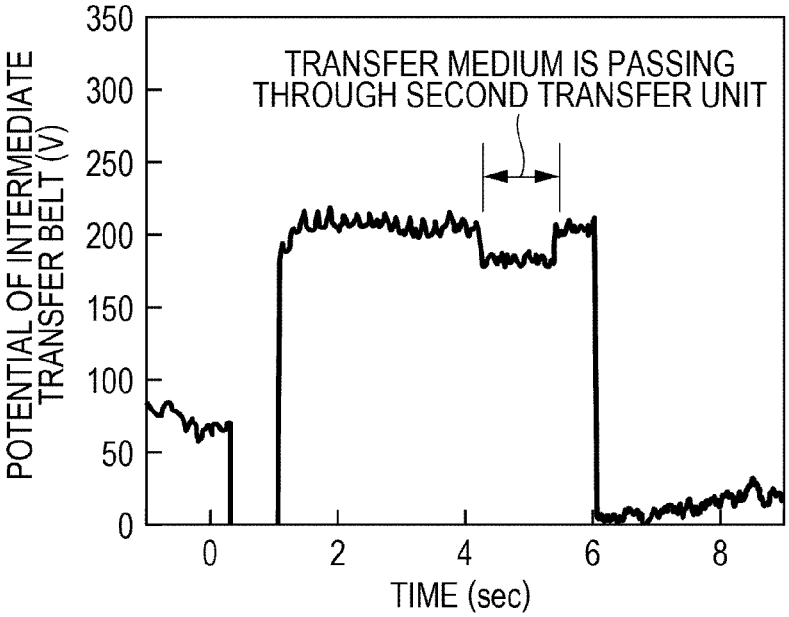
FIGS. 15A and 15B are graphs showing that the belt potential decays when a transfer medium passes through a second transfer unit.

In FIG. 15A, the potential of the intermediate transfer belt 8 is 200 V when no transfer medium P is passing through the second transfer unit, whereas the potential of the intermediate transfer belt 8 is lowered to 175 V when a transfer medium P is passing through the second transfer unit. With the lowered potential of the intermediate transfer belt 8 for the case where a transfer medium P is passing through the second transfer unit, a large amount of residual toner is generated from the first transfer and thus the first transfer performance is degraded.

In the second embodiment, the voltage to be applied to the cleaning brush 71 of the toner charging unit 75 is regulated so that the potential of the intermediate transfer belt 8 is maintained at 200 V even when a transfer medium P is passing through the second transfer unit.

Figure 16:
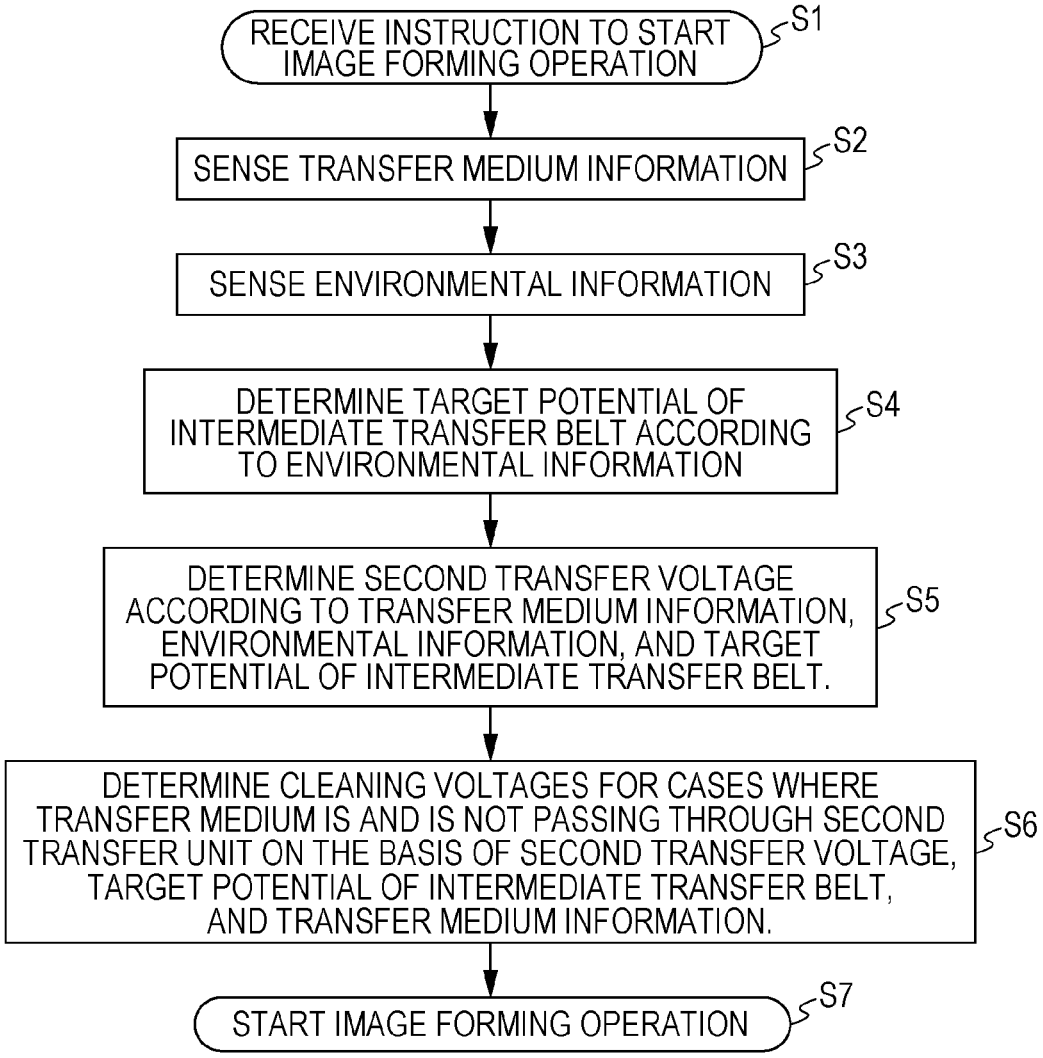
FIG. 16 is a flowchart illustrating a method of setting a charging voltage.

FIG. 16 is a flowchart illustrating how the potential of the intermediate transfer belt 8 according to this embodiment is regulated.

In Step S1, a user's operation is input, and thus an image-forming-operation start signal is input to a main body of the image forming apparatus 100 from a host apparatus (not illustrated) such as a PC or the like, together with transfer medium information including the size and a suitable print mode of a transfer medium, and the number of transfer media to be printed. In this embodiment, the transfer medium information is input from a host apparatus (not illustrated) such as PC. The present invention is not limited to this, however. A media sensor that serves as a sensing member may be disposed in the main body of the image forming apparatus 100 and the transfer medium information may be sensed by the media sensor.

In Step S2, the transfer medium information and the like that are input into the main body of the image forming apparatus 100 are stored in a memory (not illustrated). In Step S3, environmental information is transmitted from an environment sensor (not illustrated) that is disposed in the main body of the image forming apparatus 100 and that serves as an environment sensing member, and is then stored in the memory.

In Step S4, a target potential of the intermediate transfer belt 8, at which a first transfer is favorably performed under the current environmental conditions, is derived from an intermediate-transfer-belt target potential table on the basis of the environmental information stored in the memory. The derived target potential is then stored in the memory. The intermediate-transfer-belt target potential table stores in advance target potentials of the intermediate transfer belt 8 at which a first transfer is favorably performed under many different sets of environmental conditions. The target potentials have been calculated using an image forming apparatus that is similar to the image forming apparatus 100 according to this embodiment.

In Step S5, a second-transfer voltage at which a second transfer is favorably performed under the current image forming conditions is derived from a second-transfer voltage table on the basis of the transfer medium information, the environmental information, and the target potential of the intermediate transfer belt 8, which have been stored in the memory. The derived second-transfer voltage is then stored in the memory. The second-transfer voltage table stores in advance second-transfer voltages at which a second transfer is favorably performed on the basis of the transfer medium information, the environment information, and the target potential of the intermediate transfer belt 8, which have been calculated using an image forming apparatus that is similar to the image forming apparatus 100 according to this embodiment.

In Step S6, cleaning voltages (compensation voltages) that are applied from the cleaning power source 72 to the cleaning brush 71 are determined for cases where a transfer medium P is passing through the second transfer unit (for a sheet-feeding period) and where no transfer media P is passing through the second transfer unit (for a non-sheet-feeding period). The voltages that are applied to the cleaning brush 71 are derived from a compensation voltage table on the basis of the second-transfer voltage, the target potential of the intermediate transfer belt 8, and the transfer medium information, which have been stored in the memory. The compensation voltage table stores in advance voltages at which a first transfer and cleaning are favorably performed under different sets of conditions including the second-transfer voltage, the target potential of the intermediate transfer belt 8, and the transfer medium information, which are calculated using an image forming apparatus that is similar to the image forming apparatus 100 according to this embodiment. In Step S7, an image forming operation is started.

Figure 17:
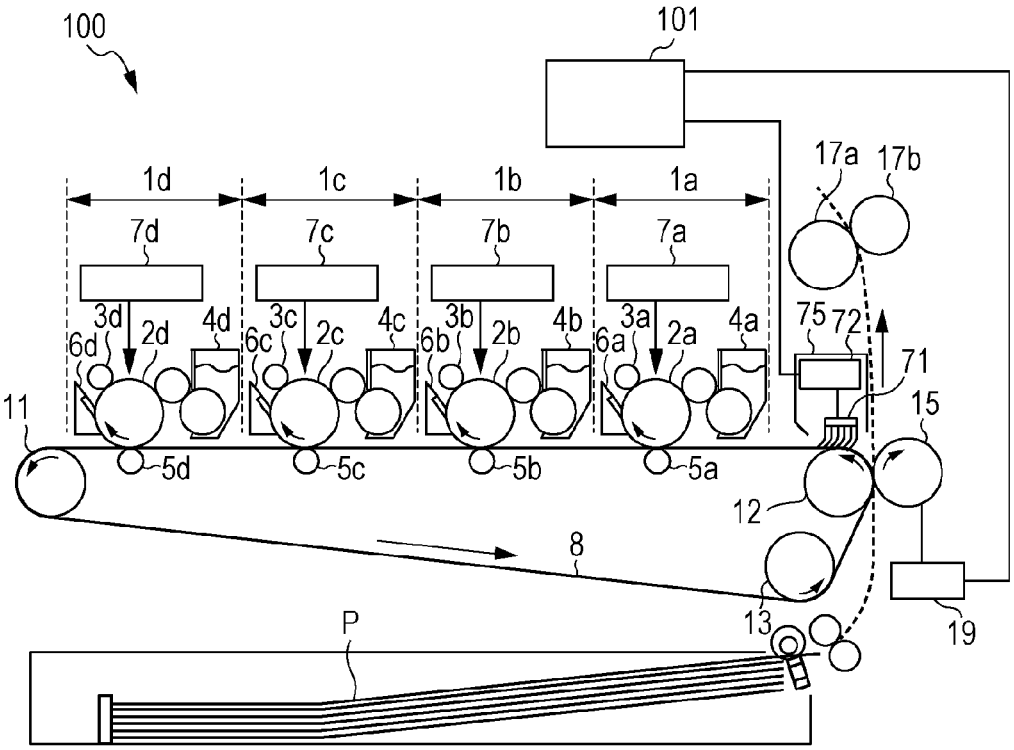
FIG. 17 is a schematic sectional view illustrating an image forming apparatus according to an embodiment of the present invention.

When the image forming operation is started, a controlling unit 101 sets the cleaning voltage that is to be applied to the cleaning brush 71 to a value for the non-sheet-feeding period. FIG. 17 illustrates the controlling unit 101. As illustrated in FIG. 17, the controlling unit 101 controls the transfer power source 19 and the charging power source 72. The controlling unit 101 may also serve as a CPU (not illustrated) that controls each image forming part.

At the timing when a transfer medium P arrives at the second transfer unit, the cleaning voltage is switched to the compensation voltage for the sheet-feeding period. After the transfer medium P has completely passed through the second transfer unit, the voltage is switched back to the cleaning voltage for the non-sheet-feeding period. Specifically, a first voltage that is applied from the cleaning power source 72 to the cleaning brush 71 while a transfer medium P is passing through the second transfer unit (during the sheet-feeding period) is set to be larger than a second voltage that is applied from the cleaning power source 72 to the cleaning brush 71 before a transfer medium P arrives at the second transfer unit (during the non-sheet-feeding period). The first voltage and the second voltage are determined in Steps S4 and S5.

Figure 15B:
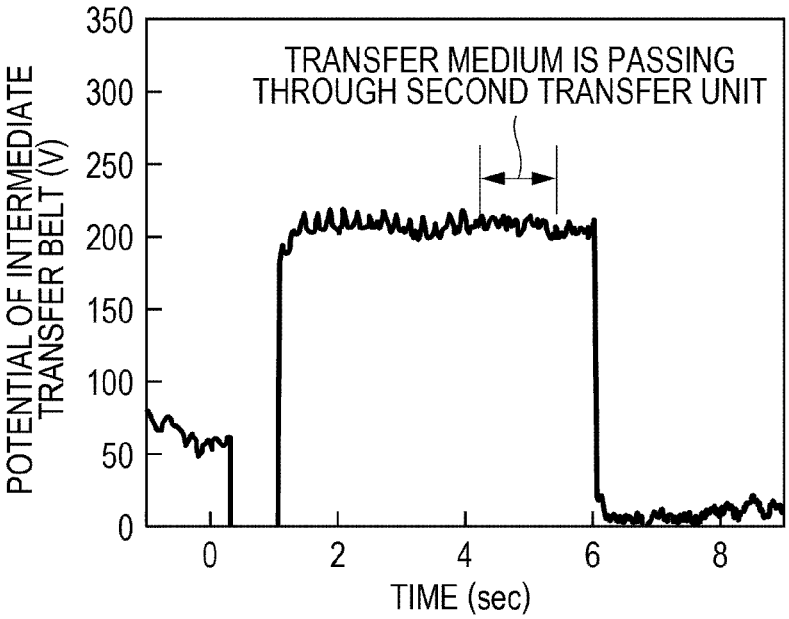

Consequently, as illustrated in FIG. 15B, the potential of the intermediate transfer belt 8 is not lowered even when a transfer medium P is passing through the second transfer unit, and is thus maintained to a constant value. At this time, the cleaning performance of each first transfer portion is also maintained at an acceptable level.

As described above, according to the embodiment of the present invention, the cleaning voltage that is applied to the cleaning brush 71 during the sheet-feeding period and the non-sheet-feeding period is regulated in accordance with the second-transfer voltage, the target potential of the intermediate transfer belt 8, and the transfer medium information. By regulating the cleaning voltage, the potential of the intermediate transfer belt 8 is less likely lowered, and thus the performance of each first transfer portion in the case of first transfers of toner is prevented from being degraded.

In this embodiment, a photosensitive drum and toner which are normally charged with a negative polarity are used. The present invention, however, is not limited to this. A photosensitive drum and toner which are normally charged with a positive polarity may be used. In this case, the polarity of voltages to be applied to components including the charging rollers 3*a*, 3*b*, 3*c*, and 3*d* and the developing units 4*a*, 4*b*, 4*c*, and 4*d* is changed according to needs.

The above-described regulation may be performed only when a high-resistance transfer medium is used. With a low-resistance transfer medium, such as a transfer medium in hot and humid surroundings, that the degree to which supply current is decreased by the resistance of the transfer medium is small. In this case, the first voltage that is applied from the charging power source 72 to the cleaning brush 71 when a transfer medium is passing through the second transfer unit (during the sheet-feeding period) may be set to the same value as the second voltage that is applied from the charging power source 72 to the cleaning brush 71 before a transfer medium arrives at the second transfer roller (during the non-sheet-feeding period).

Although the cleaning brush 71 is used as the charging member in this embodiment, the present invention is not limited to this. Rollers or other components may be used instead, as long as the rollers and the other components allow toner to be charged with a predetermined polarity. Furthermore, the charging member may be formed of multiple components by, for example, combining a brush member and a roller member.

With the use of the electrically conductive belt according to this embodiment, the potential of the belt surface of the intermediate transfer belt 8 for the cases where a transfer medium is and is not passing through the second transfer unit is maintained by regulating the voltage to be applied to the charging member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-283772, filed Dec. 20, 2010, and Japanese Patent Application No. 2011-161868, filed Jul. 25, 2011, which are hereby incorporated by reference herein in their entirety.

REFERENCE SIGNS LIST

1*a* to 1*d* image forming part
2*a* to 2*d* photosensitive drum (image bearing member)
5*a* to 5*d* opposed member
8 intermediate transfer belt
9*a* to 9*d* first-transfer voltage source
12 opposing roller for second transfer
15 second transfer roller
19 transfer power source
71 charging member
72 charging power source
101 controlling unit

The invention claimed is:

1. An image forming apparatus comprising:

a plurality of image bearing members that each bear a toner image;

a rotational endless intermediate transfer belt configured to second-transfer the toner image first-transferred from each of the plurality of image bearing members to a transfer medium;

a plurality of support rollers that support the intermediate transfer belt;

a current supply member that comes into contact with the intermediate transfer belt;

a transfer power source configured to apply a voltage to the current supply member in order for the toner image to be second-transferred from the intermediate transfer belt to the transfer medium;

a charging member that charges a residual toner remaining on the intermediate transfer belt without being second-transferred to the transfer medium; and a charging power source configured to apply a voltage to the charging member, wherein the intermediate transfer belt is a conductive belt that allows a current to flow to the plurality of image bearing members via the intermediate transfer belt from a portion that is in contact with the current supply member, in a rotational direction of the intermediate transfer belt, wherein the plurality of support rollers are connected to a constant-voltage element that maintains a surface potential of the intermediate transfer belt at a predetermined potential, and wherein, when a voltage is applied from the transfer power source to the current supply member, a current is allowed to flow from the current supply member to the plurality of image bearing members via the intermediate transfer belt, and thus the toner images are first-transferred from the plurality of image bearing members to the intermediate transfer belt.

2. The image forming apparatus according to claim 1, wherein the current supply member is a second transfer component that comes into contact with an outer peripheral surface of the intermediate transfer belt and that forms a second transfer unit together with the intermediate transfer belt, and wherein a voltage with a polarity that is opposite to a polarity with which toner is normally charged is applied from the transfer power source to the current supply member.

3. The image forming apparatus according to claim 1, wherein, when a voltage is applied from the transfer power source to the current supply member, the toner images are first-transferred from the image bearing members to the intermediate transfer belt, and concurrently, a toner image is second-transferred from the intermediate transfer belt to a transfer medium.

4. The image forming apparatus according to claim 1, wherein a circumferential resistance of the intermediate transfer belt is determined by dividing a measurement voltage that is applied from a measurement power source by a value of a current sensed by a current sensing unit connected to a second metal roller, in a state where a first metal roller that is applied with the measurement voltage is brought into contact with the intermediate transfer belt, and the second metal roller is brought into contact with the intermediate transfer belt at a portion that is separated from the first metal roller in a rotational direction of the intermediate transfer belt, and wherein the circumferential resistance of the intermediate transfer belt falls within $10^4\Omega$ to $10^8\Omega$.

5. The image forming apparatus according to claim 1, wherein the predetermined potential is a potential that is required for the toner images to be first-transferred from the plurality of image bearing members to the intermediate transfer belt.

6. The image forming apparatus according to claim 1, wherein the plurality of support rollers are connected to the constant-voltage element that is shared by the support rollers.

7. The image forming apparatus according to claim 1, wherein the constant-voltage element is a zener diode.

8. The image forming apparatus according to claim 1, wherein the constant-voltage element is a varistor.

9. The image forming apparatus according to claim 1, further comprising a plurality of opposed members located at such portions as to be opposite the plurality of image bearing members with the intermediate transfer belt interposed therebetween, wherein the plurality of opposed members allow the intermediate transfer belt and the plurality of image bearing members to come into contact with each other.

10. The image forming apparatus according to claim 9, wherein the plurality of opposed members are electrically insulated.

11. The image forming apparatus according to claim 1, wherein, when the transfer power source flows a current from the current supply member to the plurality of image bearing members through the intermediate transfer belt, surface potentials of the intermediate transfer belt in first transfer portions, to which toner images are transferred from the plurality of image bearing members, are equivalent to one another.

12. The image forming apparatus according to claim 2, further comprising a controlling unit that performs control such that a first voltage is larger than a second voltage, the first voltage being applied to the charging member when a transfer medium is passing through the second transfer unit, the second voltage being applied to the charging member when the transfer medium is not passing through the second transfer unit.

* * * * *